US005884948A

United States Patent [19]

Weinerman et al.

[11] Patent Number: 5,884,948

[45] **Date of Patent: *Mar. 23, 1999**

[54] ROTARY LATCH AND LOCK

[75] Inventors: Lee S. Weinerman, Medina; Scott A. Arthurs, Brunswick; Arthur J. Kuminski, Parma, all of Ohio

[73] Assignee: The Eastern Company, Cleveland, Ohio

[ * ] Notice: The term of this patent shall not extend beyond the expiration date of Pat. No. 5,611,224.

[21] Appl. No.: 819,396

[22] Filed: Mar. 17, 1997

Related U.S. Application Data

[63] Continuation-in-part of Ser. No. 577,720, Dec. 22, 1995, Pat. No. 5,611,224, which is a continuation-in-part of Ser. No. 510,470, Aug. 2, 1995, Pat. No. 5,564,295, which is a continuation of Ser. No. 145,691, Oct. 29, 1993, Pat. No. 5,439,260, and a continuation-in-part of Ser. No. 48,262, Dec. 22, 1995, Pat. No. Des. 390,086, which is a continuation-in-part of Ser. No. 510,470, Aug. 2, 1995, Pat. No. 5,564,295, which is a continuation of Ser. No. 145,691.

[51] Int. Cl.[6] ..... E05C 3/06

[52] U.S. Cl. ..... 292/216; 70/208; 70/472; 292/240; 292/48; 292/341.12; 292/337

[58] Field of Search ..... 292/48, 216, 341.12, 292/143, 342, 147, 74, 337, 280, 336.3, DIG. 14, DIG. 19, DIG. 51; 70/208, 134, 144, 472; 411/176, 177, 183, 172–175

[56] References Cited

U.S. PATENT DOCUMENTS

| | | | |
|---|---|---|---|
| D. 218,672 | 9/1970 | Lauper | D8/109 |
| D. 303,617 | 9/1989 | Russell et al. | D8/306 |
| D. 303,618 | 9/1989 | Russell et al. | D8/306 |

(List continued on next page.)

OTHER PUBLICATIONS

Versch Lock Mfg. Co., Inc., Columbia, SC, Two untitled product information sheets that show RSL Series Paddle Locks, date unknown but believed to be prior to Dec., 1995. See also two pages of Versch Product Photos.

Tri/Mark Corporation, New Hampton, IA, Three untitled product information sheets (believed to be pp. 8, 11 & 12 from a Tri/Mark Catalog) that show locks of the 30–175, 30–400 and 30–450 series, date unknown but believed to be prior to Dec., 1995.

Cleveland Hardware, Cleveland, OH, One untitled product information sheet showing a No. 1–2600–AH Lock, date unknown but believed to be prior to Dec., 1995.

Eberhard Manufacturing Co. (Division of the Eastern Company), Cleveland, OH, Catalog 106 entitled Industrial and Vehicular Hardware, 1994, pp. 4–9, 26, 32–36, 64–65 and 71–75.

General Motors Corp., Detroit, MI, photos showing a vehicle handle assembly Part No. 15686155 which has been available at Chevrolet dealers since at least as early as 1993.

*Primary Examiner*—Steven Meyers
*Assistant Examiner*—Teri Pham
*Attorney, Agent, or Firm*—David A. Burge

[57] ABSTRACT

A slam-capable rotary latch employs a single rotary jaw that is releasably retained in its latched position by a rotary pawl, with the latch having a pair of spaced housing side plates that sandwich the rotary jaw and the rotary pawl, with the side plates defining aligned first and second U-shaped notches that cooperate with a third U-shaped notch formed in the rotary jaw for concurrently receiving and latchingly retaining within the confines of the first, second and third U-shaped notches a suitably configured strike formation, with housing side plate portions that define a selected one of the first and second U-shaped notches being rigidified and strengthened by the close proximity presence of a flange 1) that is formed integrally with side plate portions that define the selected notch and 2) that extends transversely to bridge between the housing side plates at a location near the first and second U-shaped notches. Improvements include housing side plate formations that aid in positioning, guiding and accommodating movement of relatively movable components, and improved connections formed between non-movable components.

46 Claims, 11 Drawing Sheets

OTHER PUBLICATIONS

| | | | |
|---|---|---|---|
| D. 303,619 | 9/1989 | Russell et al. | D8/313 |
| D. 303,620 | 9/1989 | Russell et al. | D8/313 |
| D. 303,621 | 9/1989 | Russell et al. | D8/313 |
| D. 303,922 | 10/1989 | Russell et al. | D8/321 |
| D. 304,155 | 10/1989 | Russell et al. | D8/303 |
| D. 314,131 | 1/1991 | Russell et al. | D8/321 |
| 2,729,089 | 1/1956 | Pelcin | 70/151 |
| 2,793,386 | 5/1957 | Muhlhauser | 16/124 |
| 3,333,878 | 8/1967 | Pelcin | 292/37 |
| 4,309,884 | 1/1982 | Davis | 70/472 |
| 4,312,203 | 1/1982 | Davis | 70/472 |
| 4,320,642 | 3/1982 | Pastva | 70/472 |
| 4,438,964 | 3/1984 | Peters | 292/216 |
| 4,641,865 | 2/1987 | Pastva | 292/5 |
| 4,706,478 | 11/1987 | Swan et al. | 70/208 |
| 4,892,338 | 1/1990 | Weinerman et al. | 292/35 |
| 4,896,906 | 1/1990 | Weinerman et al. | 292/48 |
| 4,911,489 | 3/1990 | Hansen et al. | 292/336.3 |
| 4,917,412 | 4/1990 | Swan et al. | 292/48 |
| 4,969,916 | 11/1990 | Weinerman et al. | 70/208 |
| 5,042,853 | 8/1991 | Gleason et al. | 292/126 |
| 5,058,937 | 10/1991 | Miehe et al. | 292/34 |
| 5,069,491 | 12/1991 | Weinerman et al. | 292/48 |
| 5,117,665 | 6/1992 | Swan et al. | 70/264 |
| 5,299,844 | 4/1994 | Gleason | 292/240 |
| 5,439,260 | 8/1995 | Weinerman et al. | 292/48 |
| 5,564,295 | 10/1996 | Weinerman et al. | 70/208 |
| 5,586,458 | 12/1996 | Weinerman et al. | 70/208 |
| 5,595,076 | 1/1997 | Weinerman et al. | 70/208 |
| 5,611,224 | 3/1997 | Weinerman et al. | 70/208 |

ROTARY LATCH AND LOCK

CROSS-REFERENCE TO RELATED AND RELEVANT CASES

The present application is a continuation-in-part of application Ser. No. 08/577,720 filed Dec. 22, 1995 by Lee S. Weinerman et al entitled HANDLE OPERABLE ROTARY LATCH AND LOCK which issued Mar. 18, 1997 as U.S. Pat. No. 5,611,224, which, in turn, was filed as a continuation-in-part of application Ser. No. 08/510,470 filed Aug. 2, 1995 by Lee S. Weinerman et al entitled HANDLE OPERABLE ROTARY LATCH AND LOCK issued Oct. 15, 1996 as U.S. Pat. No. 5,564,295, which, in turn, was filed as a continuation of application Ser. No. 08/145,691 filed Oct. 29, 1993 by Lee S. Weinerman et al entitled HANDLE OPERABLE ROTARY LATCH AND LOCK which issued Aug. 8, 1995 as U.S. Pat. No. 5,439,260, which are referred to collectively herein as the "Referenced Parent Cases," the disclosures of which are incorporated herein by reference.

The present application also is a continuation-in-part of application Ser. No. 29/048,262 filed Dec. 22, 1995 by Lee S. Weinerman et al entitled HANDLE AND HOUSING FOR LATCH AND LOCK, issued as D390086 which, in turn, was filed as a continuation-in-part of the aforesaid application Ser. No. 08/510,470, which design case is referred to herein as the "Referenced Design Case," the disclosure of which is incorporated herein by reference.

Reference also is made to two other utility applications that were filed on Dec. 22, 1995 by Lee S. Weinerman et al as continuations-in-part of the aforesaid application Ser. No. 08/510,470, namely 1) application Ser. No. 08/577,717 entitled HANDLE OPERABLE ROTARY LATCH AND LOCK issued Dec. 24, 1996 as U.S. Pat. No. 5,586,458, and 2) application Ser. No. 08/577,718 entitled HANDLE OPERABLE TWO-POINT LATCH AND LOCK issued Jan. 21, 1997 as U.S. Pat. No. 5,595,076, which are referred to collectively herein as the "Referenced Sister Cases," the disclosures of which are incorporated herein by reference.

BACKGROUND OF THE INVENTION

1. Field of the Invention

The present invention relates to improvements in slam-capable rotary latches and locks of the type that form the subject matter of U.S. Pat. No. 5,564,295 and others of the Referenced Parent and Sister Cases. More particularly, the present invention relates to improvements in a rotary latch of the type that employs a single rotary jaw that is releasably retained in its latched position by a rotary pawl, with the latch having a pair of spaced housing side plates that sandwich the rotary jaw and the rotary pawl, with the side plates defining aligned first and second U-shaped notches that cooperate with a third U-shaped notch formed in the rotary jaw to concurrently receive and latchingly retain within the confines of the first, second and third U-shaped notches a suitably configured strike formation, with housing side plate portions that define a selected one of the first and second U-shaped notches being rigidified and strengthened by the close proximity presence of a flange 1) that is formed integrally with side plate portions that define the selected notch and 2) that extends transversely to bridge between the housing side plates at a location near the first and second U-shaped notches—wherein the improvements include housing side plate formations that aid in positioning, guiding and accommodating movement of relatively movable components, and improved connections formed between non-movable components.

2. Prior Art

Flush mountable, paddle-handle operated latches and locks are known that employ rotary latch bolts, also referred to as "rotary jaws," wherein the jaws are provided with U-shaped strike-receiving notches for latchingly receiving and releasably retaining suitably configured strike formations. Disclosures of latch and/or lock units of this type are found in U.S. Pat. No. 4,320,642 issued Mar. 23, 1982 to John V. Pastva, Jr., entitled PADDLE LOCKS WITH HANDLE DISCONNECT FEATURES; U.S. Pat. No. 4,917,412 issued Apr. 17, 1990 to Jye P. Swan et al, entitled VEHICLE DOOR LOCK SYSTEM PROVIDING A PLURALITY OF SPACED ROTARY LATCHES; U.S. Pat. No. 4,896,906 issued Jan. 30, 1990 to Lee S. Weinerman et al entitled VEHICLE DOOR LOCK; and, U.S. Pat. No. 5,069,491 issued Dec. 3, 1991 to Lee S. Weinerman et al entitled VEHICLE DOOR LOCK SYSTEM. The disclosures of these four U.S. patents are incorporated herein by reference.

The rotary latch and/or lock units that are disclosed in the four patents identified above are of a relatively heavy duty type that often are employed in "personnel restraint applications," typically on doors of passenger compartments of vehicles. These heavy duty units employ pairs of housing-mounted rotary jaws, with the jaws being sandwiched between pairs of housing side plates, and with notches that are formed in each pair of rotary jaws being configured to receive and engage opposite sides of a suitably configured strike formation, typically a cylindrical stem of a striker pin. While both of the housing side plates are provided with U-shaped notches, neither of these notches defines a strike engagement surface that cooperates with a notched rotary jaw to latchingly receive and releasably retain a strike formation. The notches that are formed in the jaws, not the notches that are formed in the housing side plates, receive, engage and latchingly retain suitably configured strike formations.

Lighter duty rotary latch and lock units that employ single rotary jaws also are known. For example, U.S. Pat. No. 4,312,203 issued Jan. 26, 1982 to Edwin W. Davis entitled FLUSH-MOUNTABLE LOCK WITH ACTUATOR DISCONNECT FEATURE discloses 1) the use of a single rotary latch jaw that is nested within and supported by portions of the housing of a flush mountable paddle-handle assembly, and 2) the use of a single U-shaped housing-carried notch that cooperates with the U-shaped notch formed in a rotary jaw to receive and latchingly retain a generally cylindrical strike formation. The disclosure of this fifth prior patent is incorporated herein by reference.

3. The Referenced Cases

Not addressed by the five patents that are identified above is a long-standing need for a relatively light duty rotary latch that employs only a single rotary jaw instead of a pair of rotary jaws, that employs first and second housing side plates that define, respectively, first and second notches that are of generally U-shape, with the first and second U-shaped notches being positioned and aligned for cooperating with a third U-shaped notch that is formed in the single rotary jaw to receive and latchingly retain within the confines of the first, second and third notches a suitably configured strike formation, and with the latch making advantageous use of a transversely extending flange that is formed integrally with one of the first and second housing side plates to rigidify and strengthen housing side plate portions that define a strike-engaging surface of at least one of the aligned first and second U-shaped notches. Features of the inventions of the Referenced Parent and Sister Cases address this need—and also may employ improvement features of the type that are the subject of the present invention.

The Referenced Design Case relates to a design for a Handle and Housing Assembly that may be utilized in conjunction with latches and locks of the type that are disclosed in the Referenced Parent and Sister Cases which also may employ improvement features of the type that are the subject of the present invention.

SUMMARY OF THE INVENTION

The present invention provides a number of improvements relating to rotary latches of the type that is the subject of U.S. Pat. No. 5,564,295 and that are disclosed in others of the Referenced Parent and Sister Cases—improvements that are applicable to a rotary latch of the type that includes an elongate, generally rectangular first housing side plate having opposed end regions near opposite ends of the length thereof, and defining a first U-shaped notch located near one of the opposed end regions of the first housing side plate; an elongate, generally rectangular second housing side plate having opposed end regions near opposite ends of the length thereof, and defining a second U-shaped notch located near one of the opposed end regions of the second housing side plate, with the second U-shaped notch being configured to substantially align with the first U-shaped notch; spacer means for extending transversely between, for rigidly connecting with, and for holding in substantially parallel relationship the first and second housing side plates, with the spacer means including a first spacer that extends along a first transverse axis that intersects each of the first and second housing side plates at a location that is relative near to the other end regions thereof, and with the spacer means also including a second spacer that extends along a second transverse axis that intersects each of the first and second housing side plates at a location that is substantially midway between the opposite ends thereof; with the rotary latch bolt means including a rotary jaw and a rotary pawl that extend substantially within a common plane located between the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation, and with a selected one of the first and second housing side plates being strengthened and enhanced in rigidity by the close proximity presence of a transversely extending flange that is formed integrally with the selected housing side plate.

Improvements to rotary latches and locks that are provided in accord with the preferred practice of the present invention include housing side plate formations that aid in positioning, guiding and accommodating movement of relatively movable components, and improved connections formed between non-movable components. These improvements preferably are made without altering the small number of components that preferably are utilized to provide a rotary latch or lock of the type that forms the subject matter of U.S. Pat. No. 5,564,295; nor do these improvements significantly increase production cost or add to the complexity of assembly. However, the improvements of the present invention do aid in ensuring proper functioning, reliability and service life longevity—and therefore combine to enhance the security provided by rotary latch and lock products that incorporate the improvement features.

One of the improvement features relates to the manner in which end regions of spacers (that extend between a pair of housing side plates) are connected to one or both of the housing side plates. Disclosed in the earlier Parent Patents are spacer end regions that extend through holes formed in the housing side plates, which end regions are deformed as by riveting or staking to provide non-movable connections. Disclosed in the later Parent and Sister Patents are the use of hex-shaped holes formed in one or both of the housing side plates, within which spacer end regions are enlarged to provide improved non-movable connections. Disclosed herein are the use of hex-shaped holes formed in one or both of the housing side plates with at least one end region of each spacer extending through an associated one of the hex-shaped holes and being staked to not only provide enlargements that extend into the hex-shaped holes to establish rotation-free connections, but also to provide head formations that over-lie housing side plate portions located adjacent the hex-shaped holes to further enhance the integrity of the non-movable connections that are established.

Another improvement feature relates to housing side plate formations that preferably are provided when at least one of the housing side plates is formed by stamping —including formations that extend toward a common central plane (that is occupied by the rotary jaw and the rotary pawl) to guide and maintain proper positioning one or both of the rotary jaw and the rotary pawl within the common central plane. While the Parent Patents disclose a convex projection formed on an interior side of a housing side plate (which is formed by stamping a recess in the opposite side of the housing side plate) that has been used to aid in positioning the rotary jaw and the rotary pawl, such a recess now preferably is used in combination with an additional, strategically located, interiorly extending projection (which is formed by precisely stamping a dimple in the opposite side of the housing side plate) to aid in guiding and maintaining proper positioning of the rotary jaw within the common central plane during its angular movements and when at rest.

Still another of the improvements that preferably are provided when at least one of the housing side plates is formed by stamping includes a pair of arcuate-shaped concave recess formations in the interior face of the housing side plate (that open toward the central plane occupied by the rotary jaw and the rotary pawl)—with these recesses being configured to receive and accommodate angular movements of end regions of a torsion coil spring (that operates on the rotary jaw and the rotary pawl to cause angular movements that are needed for proper functioning of the latch). In rotary latches and locks of the subject type wherein it has been found to be desirable for torsion spring ends to securely engage the rotary jaw and the rotary pawl by wrapping about these elements, a conflict can occur in satisfying the need for a close fit of relatively movable components (to ensure proper operation) and the need for sufficient clearance to exist to accommodate angular movements of spring ends in the narrow space that exists between the housing side plate and the rotary jaw and pawl.

By providing arcuate-shaped recesses (that add to the space that is available between a housing side plate and the rotary jaw and pawl) to receive torsion spring end regions therein and to provide for their angular movement during latching and unlatching of the rotary latch or lock, detrimental effects of wear due to friction and/or possible wedging of spring ends between the housing side plate and the rotary jaw and pawl are minimized. And, by confining the spring ends to these recesses, the likelihood that the ends will become disconnected from the rotary jaw and pawl also can be minimized—whereby the overall result constitutes an improvement of consequence.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENTS

Figure 1:
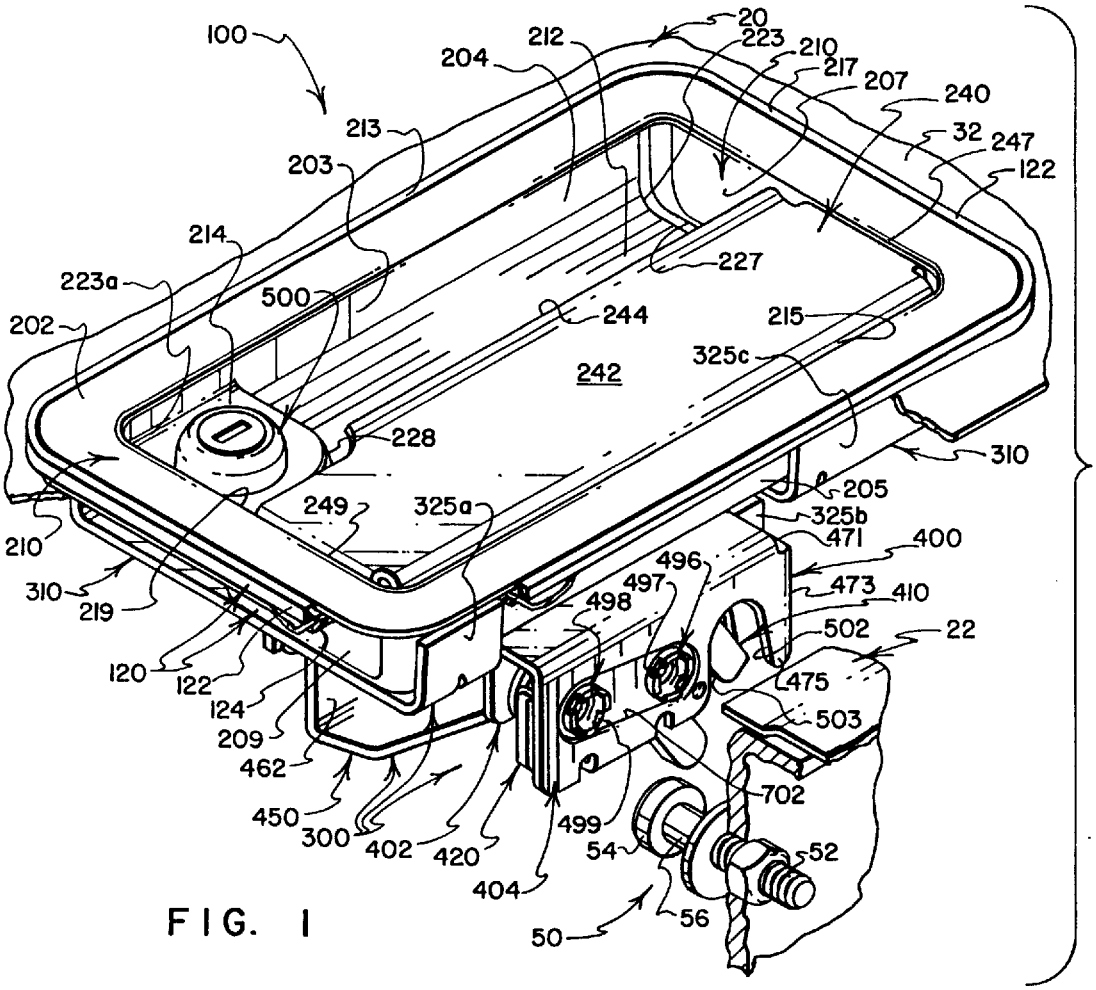
FIG. 1 is front perspective view of a handle operable rotary latch and lock unit installed on a closure of a cabinet and being operable to latchingly engage a strike that is installed on a part of the cabinet that is situated near the closure when the closure is closed, with an operating handle shown in its non-operated position, with a rotary jaw shown in its unlatched position ready to be slammed into latching engagement with the strike, and with portions of the cabinet and closure being broken away.

Features of the present invention can be employed to advantage on so-called "stand-alone" rotary latch and lock products, and on rotary latches and locks that have other integrally formed or intimately connected components. Accordingly, an embodiment having "other connected components" is illustrated in FIGS. 1–15, "stand-alone" embodiments are illustrated in FIGS. 22–25, and a more detailed depiction of improvement features that preferably are incorporated in all of the embodiments of FIGS. 1–16 and 22–25 are illustrated in FIGS. 16–21.

Referring to FIGS. 1–11, a handle operable rotary latch and lock unit 100 is shown mounted on a cabinet door or closure 20. The closure 20 typically is formed from a stamped metal sheet 32, or as an assembly of plural metal sheets (not shown) , with a generally rectangular opening 34 (see FIGS. 5, 8, 11 and especially FIG. 12) being provided through the sheet 32 (through which portions of the lock unit 100 project). The closure 20 is movable between open and closed positions with respect to adjacent cabinet structure 22 (portions of which are depicted in FIGS. 1, 5, 8, 11).

Figure 2:
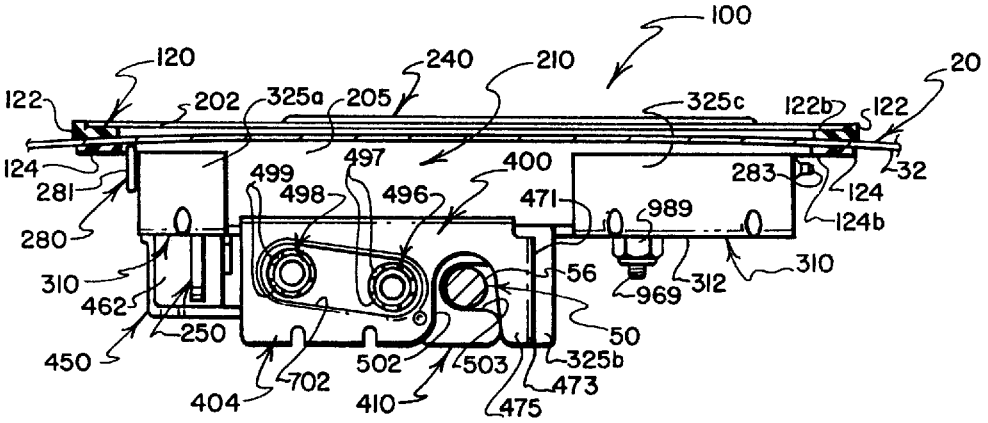
FIG. 2 is a side elevational view of the unit of FIG. 1, with the rotary jaw shown latchingly engaging portions of the strike, and with closure portions that extend adjacent the unit being shown in cross section.
Figure 4:
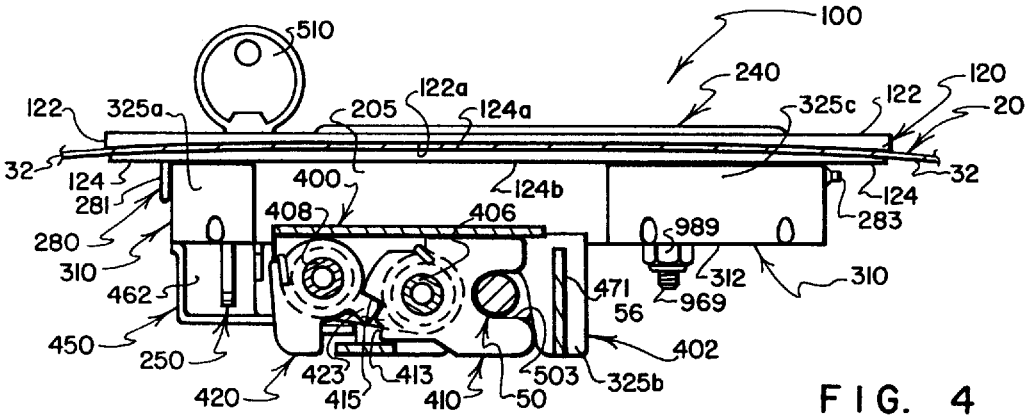
FIGS. 4 and 5 are sectional views as seen from planes indicated by lines 4—4 and 5—5 in FIG. 3, with relatively movable components of the unit positioned as is depicted in FIGS. 2 and 3, but with a key inserted in the key-operated lock assembly of the unit.
Figure 5:
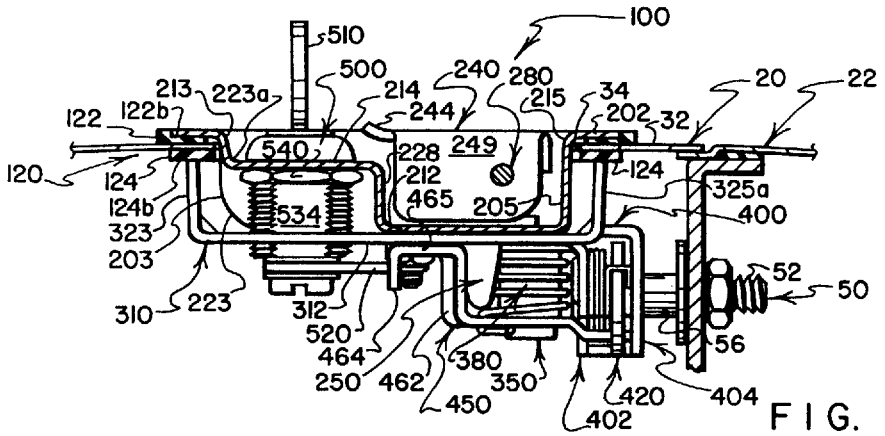
Figure 13:
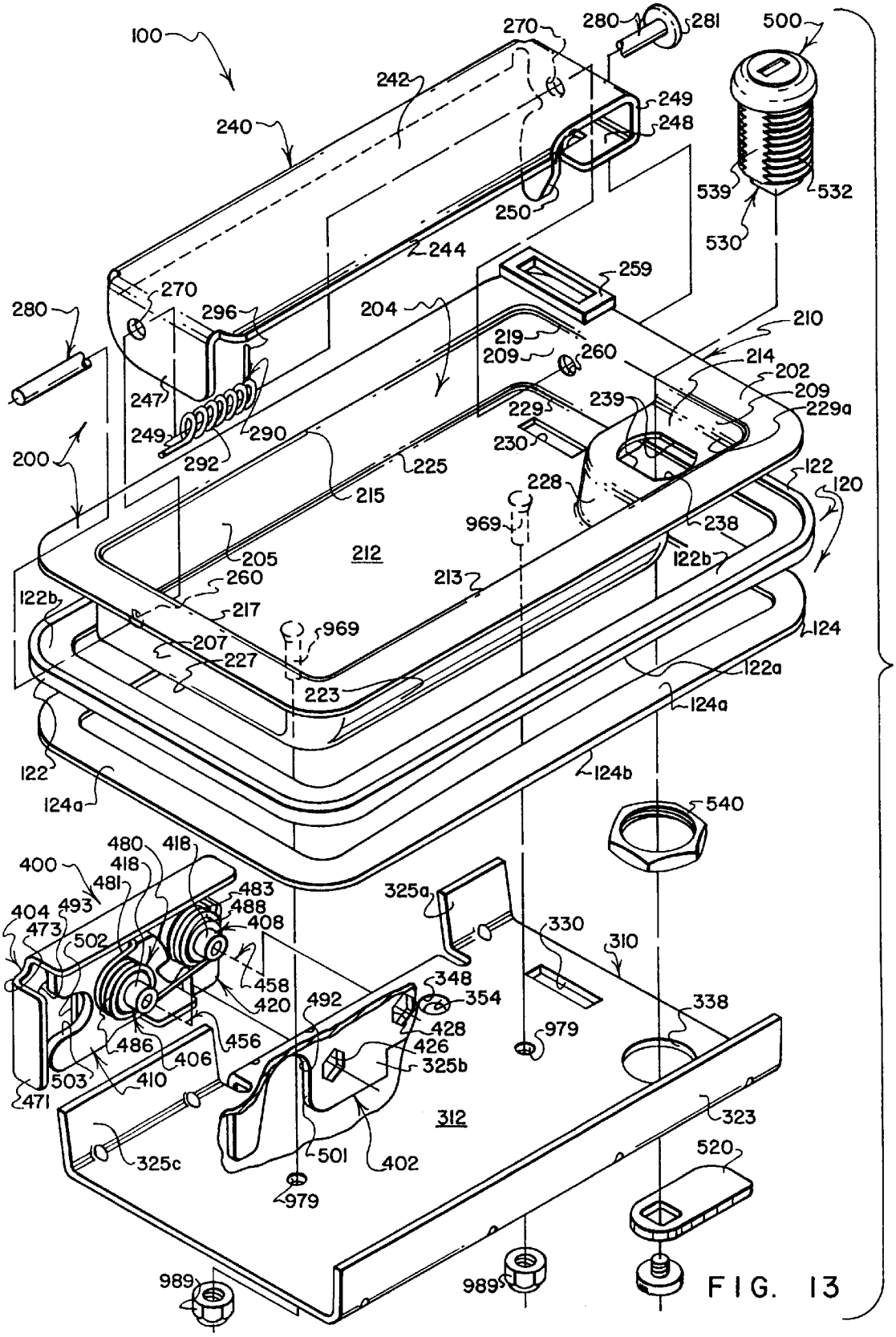

A curved-mount gasket set 120 is provided to seal about the opening 34 between the unit 100 and the closure 20 (inasmuch as the closure 20 is depicted, for example in FIGS. 2, 4 and 5, as being slightly curved). Referring to FIG. 13, the curved-mount gasket set 120 includes outer and inner gaskets 122, 124 that have curved surfaces 122*a*, 124*a* for engaging outer and inner sides of the curved metal sheet 32 adjacent the opening 34, and flat surfaces 122*b*, 124*b* that are engaged by outer and inner portions of the lock unit 100 that is mounted in the opening 34 (as will be explained)—whereby it will be understood that the outer and inner gaskets 122, 124 are of non-uniform thickness in order to accommodate the curvature of the closure 20. Simple flat gaskets (not shown) may, of course, be used if the closure 20 is flat in the vicinity of the opening 34, as will be readily understood by those who are skilled in the art.

Figure 7:
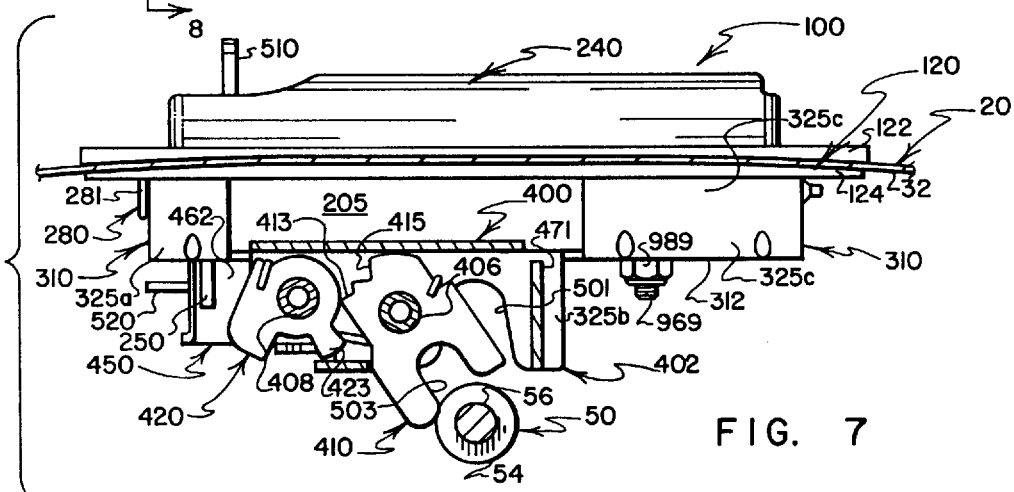
FIGS. 7 and 8 are sectional views as seen from planes indicated by lines 7—7 and 8—8 in FIG. 6, with relatively movable components of the unit positioned as is depicted in FIG. 6, and with the strike disengaged from the rotary jaw.

Mounted on the cabinet structure 22 is a strike 50 (best seen in FIGS. 1, 7, 8 and 12). While a strike that is suitably configured for use with the rotary latch and lock unit 100 can take a wide variety of forms, the elongate, "headed and threaded pin" form that is depicted in FIGS. 1, 7, 8 and 12 ordinarily is preferred. On one end of the strike 50, threads 52 are provided. On the opposite end of the strike 50, an enlarged diameter head 54 is formed. A generally cylindrical central region 56 is interposed between the threads 52 and the head 54, and provides an example of what is referred to herein as a "suitably configured strike formation." The cylindrical central region 56 1) is "slammable" into latching engagement with the rotary jaw 410 (when the rotary jaw 410 is "unlatched," as is best seen in FIGS. 1 and 7); 2) is receivable within a U-shaped notch 503 of the rotary jaw 410 (see, for example, FIGS. 2, 4 and 10); and, 3) cooperates with the rotary jaw 410 to latch the door 20 in its closed position (see, for example, FIGS. 2, 4 and 5).

Figure 8:
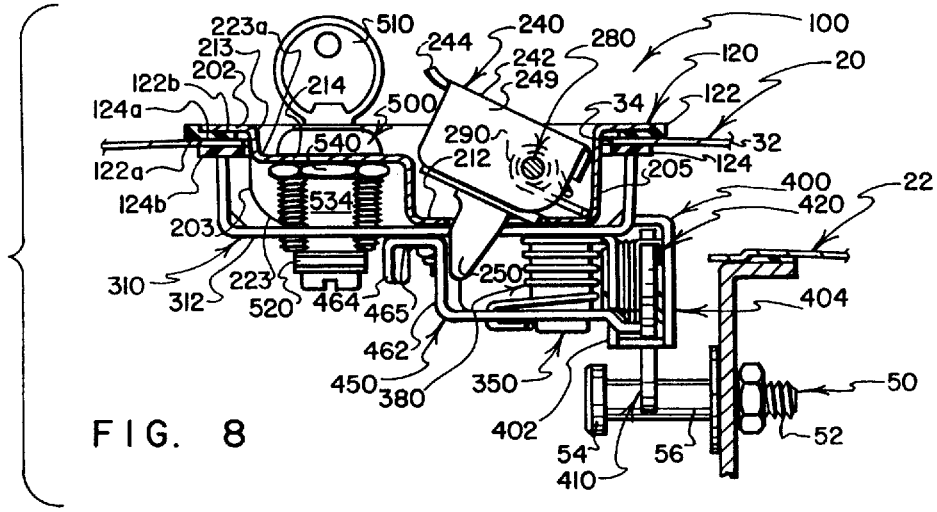
Figure 9:
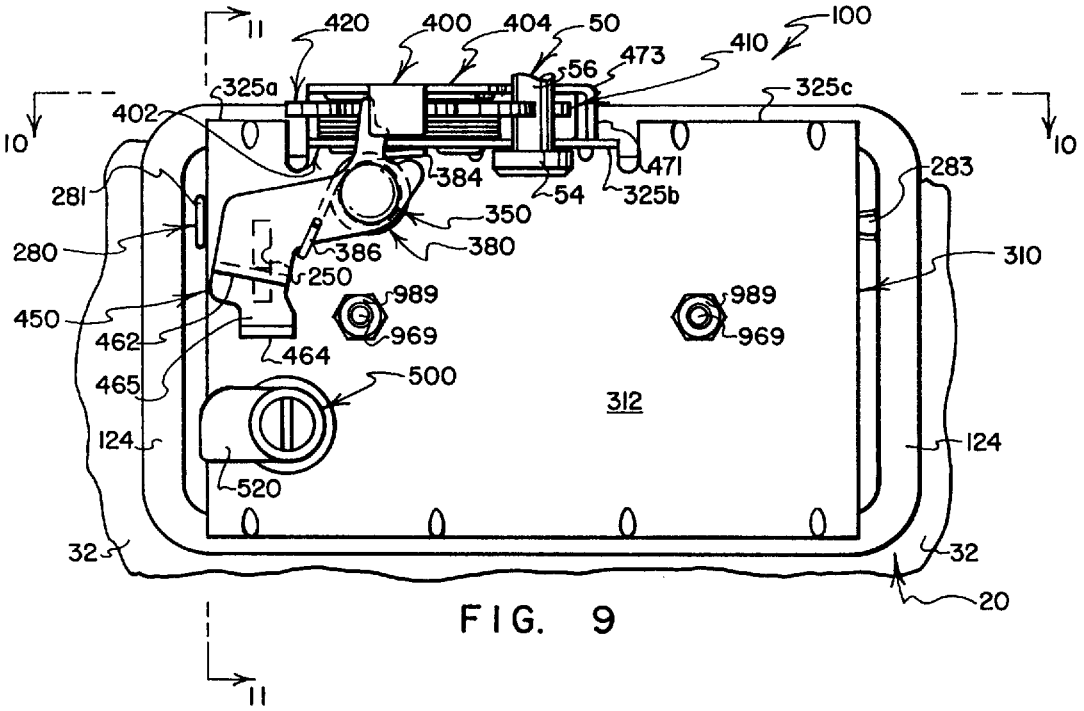
FIG. 9 is a bottom plan view similar to FIG. 6 but with the rotary jaw in a preliminary stage of latching engagement that is experienced by the unit as the closure is moved toward its fully closed position.
Figure 10:
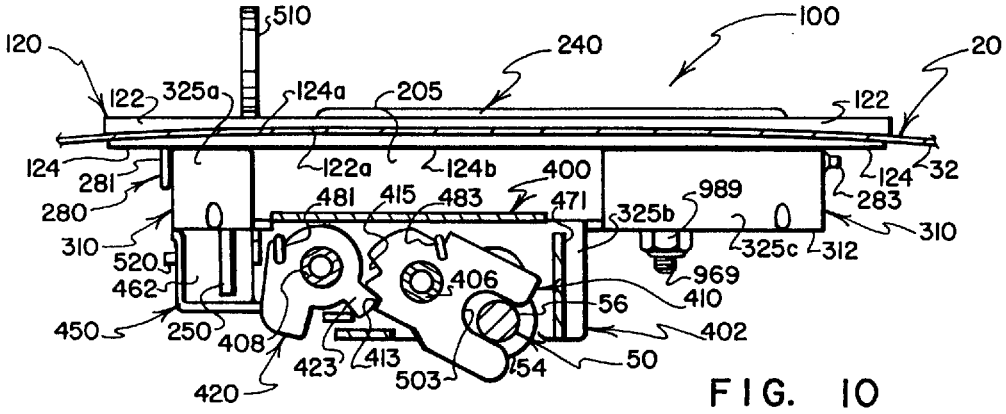
FIGS. 10 and 11 are sectional views as seen from planes indicated by lines 10—10 and 11—11 in FIG. 9, with relatively movable components of the unit positioned as is depicted in FIGS. 4 and 5 except for the angular positions of the rotary jaw and pawl of the unit.
Figure 11:
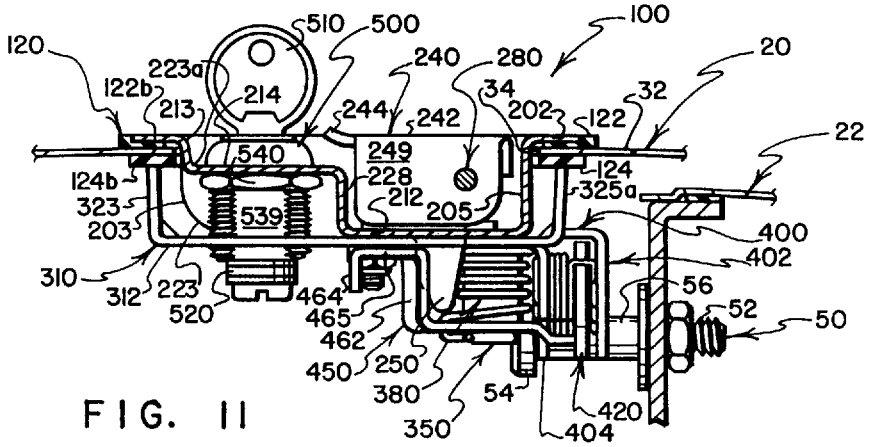

One of many possible "open" positions of the door 20 is depicted in FIG. 1, with another possible "open" position being depicted in FIGS. 7 and 8—wherein a rotary jaw 410 of the unit 100 is shown "unlatched" (i.e., the strike portion 56 is not being retained by the rotary jaw 410) and ready to be slammed into latching engagement with the strike 50 that is mounted on the cabinet structure 22. The "closed" position of the door 20 is depicted in FIGS. 2–5—wherein the rotary jaw 410 is shown receiving and latchingly retaining a generally cylindrical portion 56 of the strike 50. A "nearly closed" or "preliminarily latched" position of the door 20 is depicted in FIGS. 9–11—wherein the rotary jaw 410 is shown latchingly retaining the strike portion 56 to a sufficient degree that operation of the handle 240 is required to release a rotary pawl 420 from engaging the rotary jaw 410 to cause the spring-biased rotary jaw 410 to move from its "partially latched" position (best seen in FIG. 10) toward its unlatched position (best seen in FIG. 7).

Figure 12:
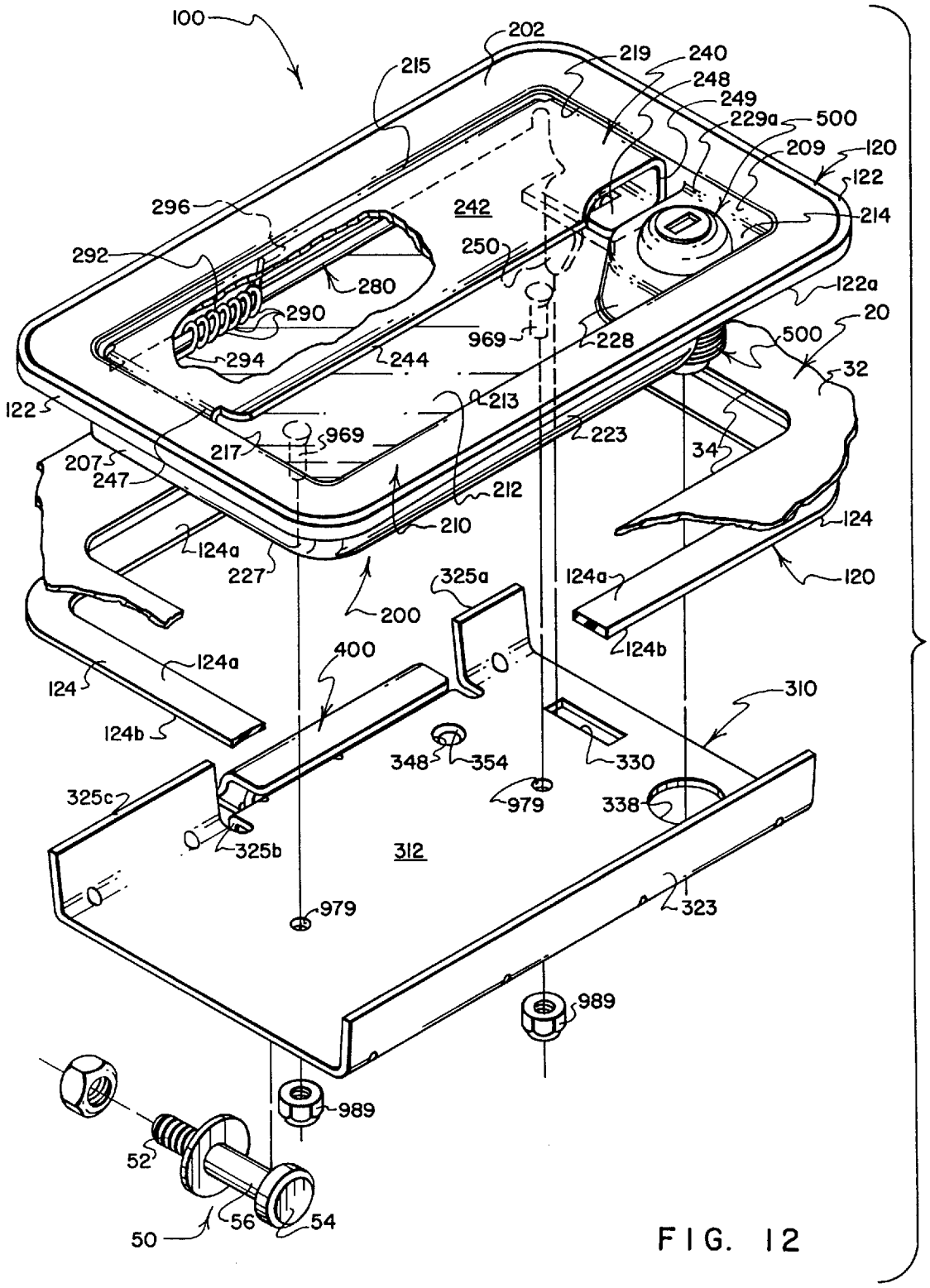
FIGS. 12, 13 and 14 are exploded front perspective views of selected components of the rotary latch and lock unit of FIGS. 1–11, with some components separated so as to be depicted individually, with other components shown assembled, and with some component portions broken away to permit underlying features to be viewed.
Figure 14:
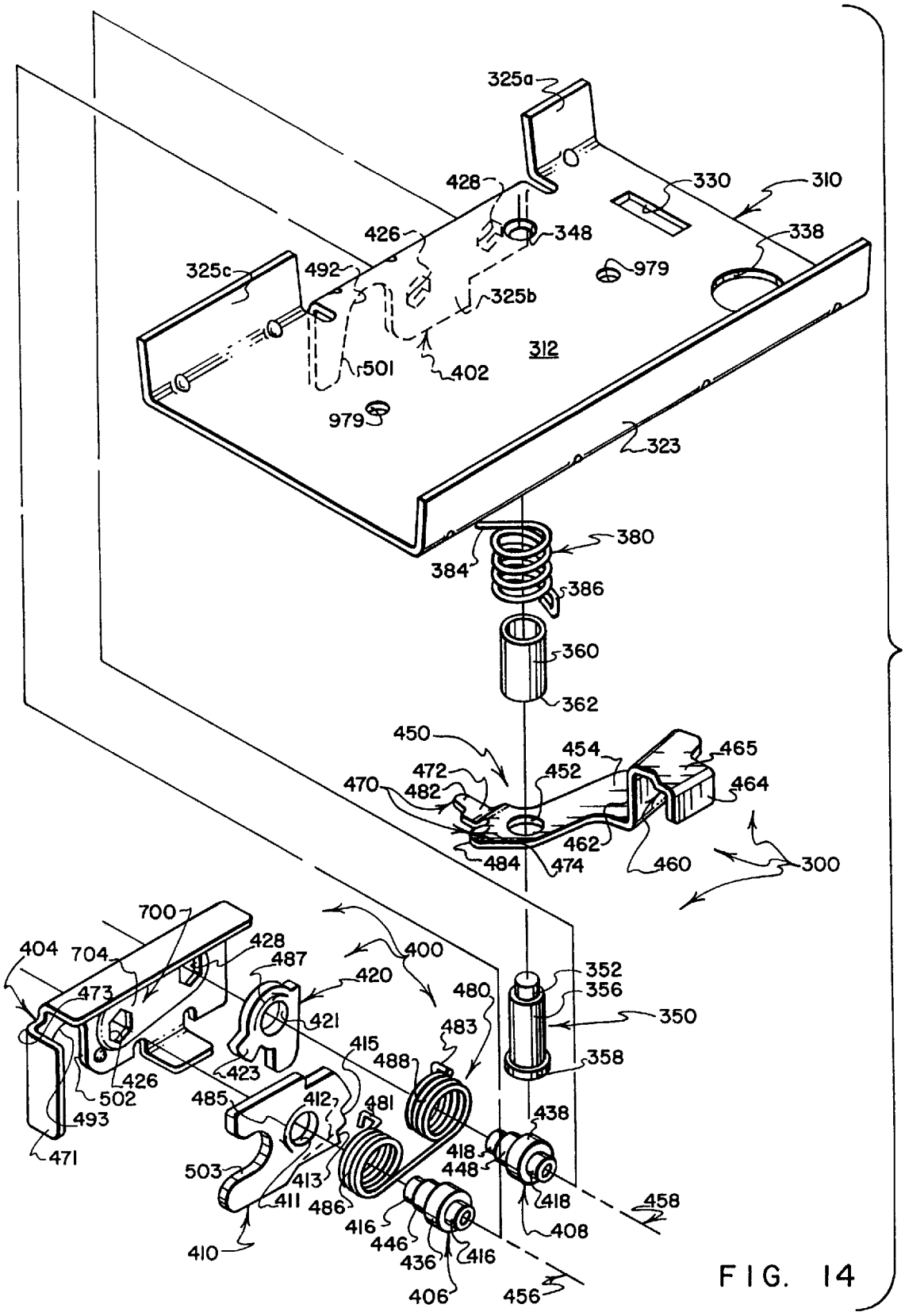
Figure 15:
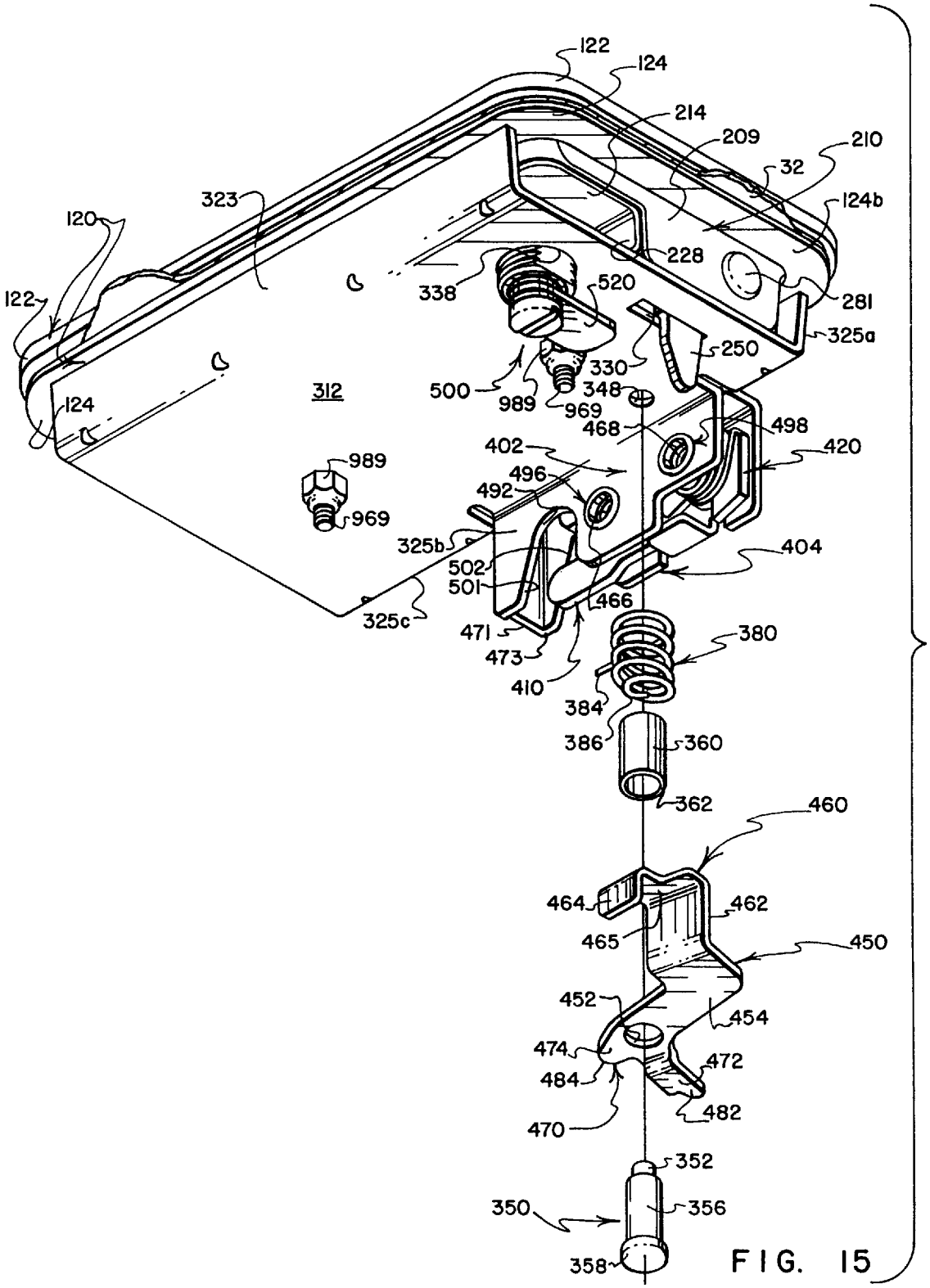
FIG. 15 is an exploded rear perspective view showing selected components of the unfit of FIGS. 1–14, with some components separated so as to be depicted individually, and with other components shown assembled.

Three modular assemblies 200, 300, 500 form the latch and lock unit 100. Referring to FIGS. 12 and 13, a pan-shaped housing 210, a paddle-shaped handle 240, a hinge pin 280, and a torsion coil spring 290 comprise what will be referred to as a "front mountable modular assembly" or "handle and housing assembly" 200. Referring to FIGS. 13 and 14, a mounting bracket 310, a rotary latch subassembly 400, and an operating arm 450 comprise what will be referred to as a "rear mountable modular assembly" or "bracket, latch and linkage assembly" 300. Referring to FIGS. 12, 13 and 15, a "third modular assembly" takes the form of a conventional, commercially available, "key operated cam lock assembly" 500 that can be operated by a suitably configured key 510 (see FIGS. 4, 5, 7, 8 and 10 wherein the bow of the key 510 is shown projecting forwardly from the cam lock assembly 500).

Turning to features of the "front mountable modular assembly" or "handle and housing assembly" 200, and referring to FIGS. 1, 12 and 13, the pan-shaped housing 210 is a generally rectangular metal stamping having a perimetrically extending, substantially flat mounting flange 202 which surrounds a forwardly facing recess 204. Opposed, relatively long side walls 203, 205, and opposed, relatively short end walls 207, 209 are joined by small radius bends 213, 215, 217, 219 to the flat mounting flange 202.

A majority of the recess 204 is relatively deep, and is closed by a main back wall portion 212 that is substantially flat. A corner region of the recess 204 located near the juncture of the side and end walls 203, 209 is more shallow, and is closed by a minor back wall portion 214 that also is substantially flat. Relatively small radius bends 223*a* (FIG. 5), 229*a* (FIGS. 12–13) join portions of the side and end walls 203, 209 to the minor back wall portion 214. A curved wall 228 joins the minor back wall portion 214 to the main back wall portion 212, with small radius bends being provided where the curved wall 228 joins with the back wall portions 212, 214. Referring variously to FIGS. 1, 12 and 13, relatively small radius bends 225, 227, 229 join portions of the side and end walls 205, 207, 209 to the main back wall portion 212. A relatively larger radius bend 223 joins portions of the side wall 203 to the main back wall portion 212.

Referring to FIG. 13, a main back wall opening 230 is formed through the main back wall portion 212; and, a lock mount opening 238 is formed through the minor back wall portion 214. The main back wall opening 230 is elongate, generally rectangular, is spaced a short distance from the housing end wall 229, and extends parallel to the housing end wall 229. The lock mount opening 238 is generally circular except for two flats 239 formed along opposite sides thereof.

Referring principally to FIGS. 12 and 13, the paddle-shaped handle 240 has a generally rectangular front wall 242 with a forwardly-turned lip 244 formed along one edge. Rearwardly-turned end flanges 247, 249 border opposite ends of the rectangular front wall 242 and extend alongside the housing end walls 207, 209, respectively. The end flange 249 has an inwardly-turned extension 248 that parallels the front wall 242 of the handle 240, and that carries a rearwardly projecting tab-like formation 250 that extends through the main back wall opening 230. Referring to FIG. 12, an optional, generally rectangular gasket 259 may be provided to surround portions of the projection 250 at a location adjacent the back wall opening 230.

Referring to FIG. 13, the hinge pin 280 extends through aligned holes 260 that are formed through the end walls 207, 209 of the pan-shaped housing 210, and through aligned holes 270 that are formed through the rearwardly-turned flanges 247, 249 of the paddle-shaped handle 240 to pivotally mount the handle 240 on the housing 210. A head 281 is formed on one end of the pin 280. While the opposite end of the pin initially is pointed (as depicted in FIG. 13) to facilitate assembly, once the pin 280 has been inserted through the holes 260, 270 to pivotally mount the handle 240 on the housing 210, a crimp 283 is formed (see FIGS. 3 and 4) to prevent removal of the pin 280 from the holes 260, 270.

Referring to FIGS. 12 and 13, the torsion coil spring 290 has a coiled central region 292 that extends loosely about the hinge pin 280 at a location between the rearwardly-turned flanges 246 of the handle 240, and has opposed end regions 294, 296 that engage the back wall 212 and the handle 240, respectively, to bias the handle 240 away from its "extended" or "operated" position (see FIGS. 7 and 8) toward its "nested" or "non-operated" position (see FIGS. 1, 5 and 12).

When the operating handle 240 is moved away from its nested, non-operated position toward its extended, operated position (by pivoting about the axis of the pin 280), the rearwardly extending handle tab projection 250 is caused to move within the back wall opening 230 (from a normal or "first" position that is depicted in FIG. 5 to a "second" position that is depicted in FIG. 8). As will be explained shortly, this movement of the tab 250 within the confines of the back wall opening 230 causes the operating arm 450 to "unlatch" the rotary latch subassembly 400 from latchingly engaging the strike 50 by moving from a normal or "primary" position of the operating arm 450 (depicted in FIG. 3) to a "secondary" position of the operating arm 450 (depicted in FIG. 6).

Turning now to features of the "rear mountable modular assembly" or "bracket, latch and linkage" assembly 300, and referring to FIGS. 12–15, the mounting bracket 310 has a relatively flat, generally rectangular-shaped central region 312 with a forwardly turned side flange 323 (configured to extend the full length along the housing side wall 203 when the front and rear modules 200, 300 are assembled), and with forwardly turned side flange portions 325*a*, 325*c* (configured to extend along portions of the housing side wall 205 at locations on opposite sides of the rotary latch subassembly 400 when the front and rear modules 200, 300 are assembled). At a location between the forwardly turned flange portions 325*a*, 325*c*, the mounting bracket also defines a rearwardly turned flange 325*b*. The rearwardly turned flange 325*b* forms a part of the rotary latch subassembly 400, as will be explained below.

Referring to FIGS. 12–15, an elongate, generally rectangular opening 330 is formed through the flat central portion 312 of the mounting bracket 310 to align with the main back wall opening 230 when the mounting bracket 310 is mounted together with the handle and housing assembly 200 on the closure 20—which alignment is provided to enable the the rearwardly projecting formation 250 of the handle 240 to extend through the opening 330 to engage the operating arm 450. A feature that is provided by the closely spaced, aligned housing and mounting bracket openings 230, 330 is that they cooperate to protectively enshroud the rearwardly projecting formation 250 to prevent it from bending or breaking either during normal service or as the result of tampering.

Optionally formed through the flat central portion 312 of the mounting bracket 310 is a circular opening 338 that is located to align with the lock mounting opening 238 of the pan-shaped housing 210 to permit the lock assembly 500 to pass therethrough in a close fit. A feature that is provided by the close fit of the circular opening 338 about body portions of the lock assembly 500 is that the material of the mounting bracket 310 that extends about the opening 338 will help to reinforce and rigidify the mounting of the lock assembly 500 in the lock mounting opening 238 to prevent damage from occurring due either to extensive normal service or as the result of tampering or forcing of the lock 100.

Referring to FIG. 14, a tapered hole 348 is formed through the flat central portion 312 of the mounting bracket 310 to receive a reduced diameter end region 352 of a mounting post 350. The mounting post 350 is rigidly attached to the mounting bracket 310 by deforming and expanding the reduced diameter end region 352 to form an enlarged head 354 that substantially fills the tapered hole 348, as is depicted in FIGS. 12 and 13.

Figure 3:
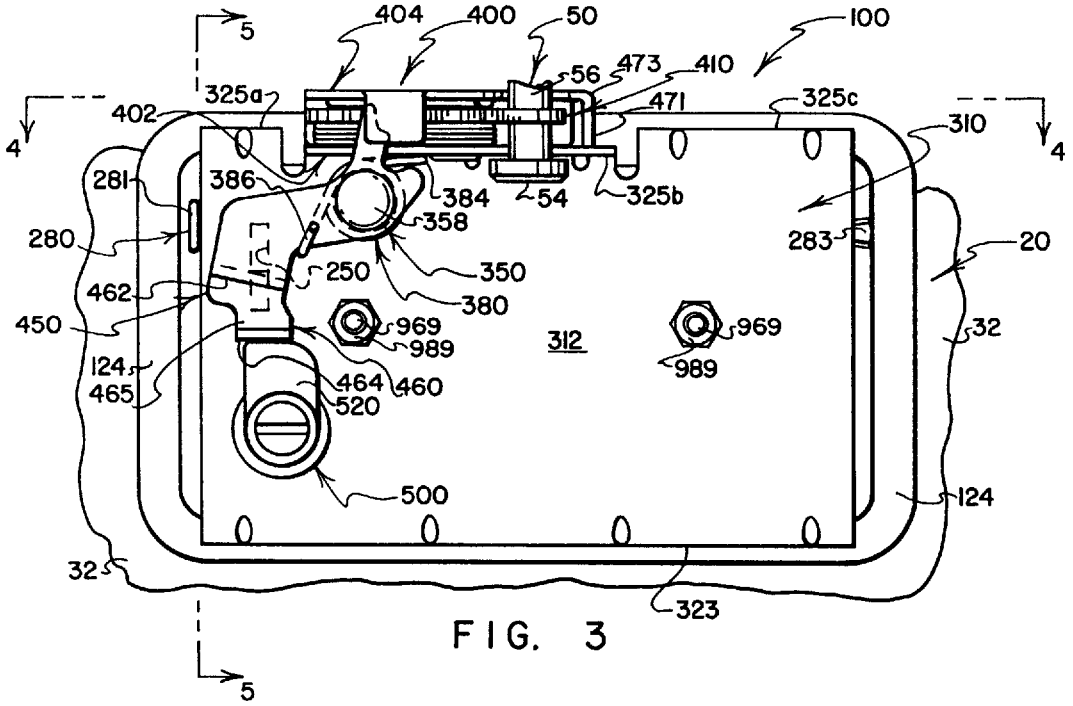
FIG. 3 is a bottom plan view of the unit, with relatively movable components thereof positioned as is depicted in FIG. 2, with a cam of a key-operated lock assembly shown in its locked position, and with portions or several components broken away.
Figure 6:
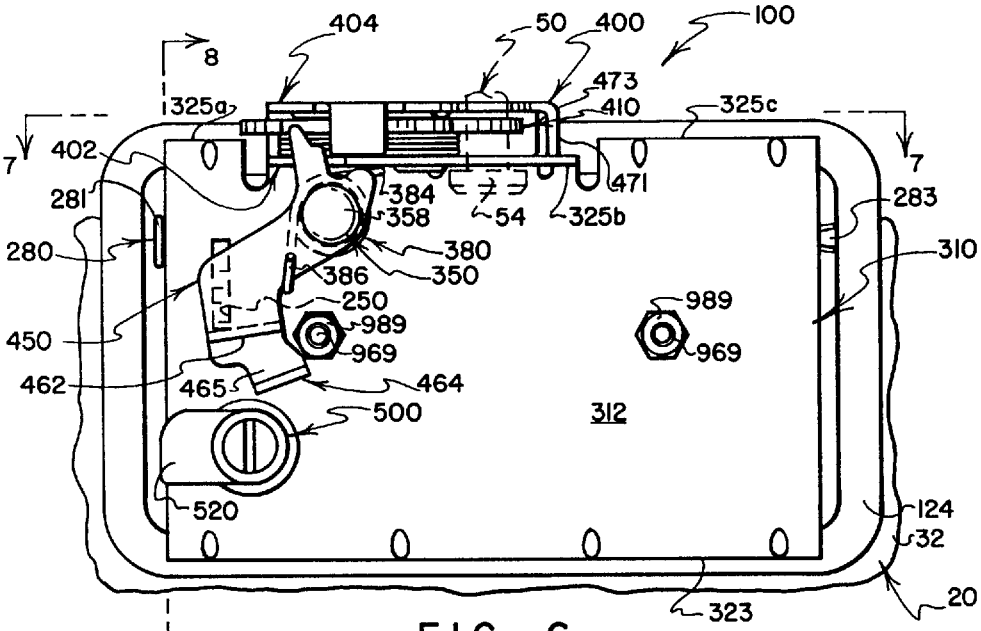
FIG. 6 is a bottom plan view similar to FIG. 3 but with the cam of the lock assembly in its unlocked position, and with an operating handle of the unit in an operated position that causes an operating arm to unlatch the rotary jaw for movement out of its latched position.

Referring to FIGS. 14 and 15, the mounting post 350 has a generally cylindrical central region 356 that extends rearwardly to where an enlarged head 358 is formed. A sleeve 360 is mounted in a slip fit on the central region 356 and extends rearwardly from the flat central wall 312 of the mounting bracket 310 to define an end 362 that is spaced a short distance from the head formation 358. The operating arm 450 has a mounting hole 452 that is sized to receive the central region 356 in a slip fit (that will permit the operating arm 450 to pivot smoothly relative to the mounting post 350 between the "primary" position of the operating arm 450 which is depicted in FIG. 3 and the "secondary" position of the operating arm 450 which is depicted in FIG. 6). The operating arm 450 is mounted on the mounting post 350 at a location between the head formation 358 and the end 362 of the sleeve 360, with the central region 356 extending through the mounting hole 452.

Referring still to FIGS. 14 and 15, a torsion coil spring 380 has coils 382 located between opposite ends 384, 386. The coils extend about the sleeve 360 to mount the spring 380 on the mounting post 350 at a location between the flat wall 312 of the mounting bracket 310 and the operating arm 450. Referring to FIGS. 3, 6 and 9, the spring end 384 extends away from the mounting post 350 to engage the rearwardly turned mounting flange portion 325*b*, while the spring end 386 engages the operating arm 450 to bias the operating arm 450 (in a clockwise direction as viewed in FIGS. 3, 6 and 9 away from the "secondary" position of the operating arm 450 depicted in FIG. 6 toward the "primary" position of the operating arm 450 depicted in FIG. 3).

Referring again to FIGS. 14 and 15, the operating arm 450 has a rather complex dog-legged configuration that includes a substantially flat, elongate central region 454 (through which the mounting hole 452 is formed) that extends between one end where a U-shaped formation 460 is provided, and an opposite end where a forked or Y-shaped formation 470 is provided.

The U-shaped formation 460 is defined by first and second forwardly-rearwardly extending legs 462, 464 that are interconnected near their forward ends by a base leg 465. The U-shaped formation 460 serves the dual functions 1) of providing the leg 462 to be engaged by the rearwardly projecting formation 250 of the handle 210 (so that the operating arm 450 will be moved by the rearwardly projection formation 250 when the handle 240 pivots about its mounting pin 280), and 2) of providing the leg 464 to be selectively engaged and disengaged by a cam 520 of the lock mechanism 500 (to "lock" and "unlock" the unit 100 in response to operation by the key 510 of the lock assembly 500).

The forked or Y-shaped formation 470 is defined by first and second branches 472, 474 that diverge to define at their ends, a pawl-engaging formation 482 and a stop formation 484, respectively. The Y-shaped formation 470 serves the dual functions 1) of providing the pawl-engaging formation 482 for engaging the pawl 420 of the rotary latch subassembly 400 for operating the pawl 420 (in a manner that will be described below) when the operating arm 450 is pivoted about the mounting post 350 from the position depicted in FIG. 3 to the position depicted in FIG. 6, and 2) of providing the stop formation 484 for engaging the rearwardly turned flange portion 325*b* of the mounting bracket 310 to "stop" pivotal movement of the operating arm 450 (caused by the projection 250 being pivoted with the handle 240 about the axis of the mounting pin 280) to the position depicted in FIG. 6.

Turning to features of the rotary latch subassembly 400 (that forms a part of the bracket, latch and linkage assembly 300), and referring to FIGS. 13 and 14, the subassembly 400 has what will be referred to as a "housing" that consists of first and second "housing side plates" 402, 404. The side plate 402 is not an independent member, but rather is defined by the rearwardly turned flange 325*b*—and thus is an integral part of the one-piece mounting bracket 310. The side plate 404 is formed as separate stamping, and is held in spaced, parallel relationship to the side plate 402 by first and second spacers or bushings 406, 408.

Referring to FIG. 14, the first and second bushings 406, 408 are tubular (i.e., they have hollow interiors), and have reduced diameter end regions 416, 418 that are sized to extend through and to be received in a slip fit within hex-shaped holes 426, 428 (see also FIG. 13) that are formed in the side plates 402, 404, respectively. To securely retain the hollow, reduced diameter end regions 416, 418 in the hex-shaped holes 426, 428 (to thereby securely establish rigid, rotation-resistant connections between the bushings 406, 408 and the housing side plates 402, 404), the end regions 416, 418 are deformed and enlarged so as to expand portions of the end regions 416, 418 into continuously seated engagement with the hex holes 426, 428, and to further enlarge portions of the end regions 416, 418 to form heads 496, 498 at opposite ends thereof (see FIG. 15 wherein rounded heads 496, 498 that are formed adjacent the housing side plate 402 are depicted, and FIGS. 1 and 2 wherein heads 496, 498 are shown that are additionally staked to form depressed regions 497, 499).

Figure 16:
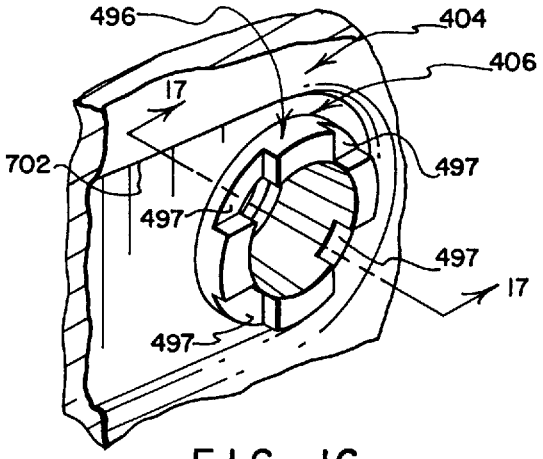
FIG. 16 is a perspective view, on an enlarged scale, showing a typical staked, headed end region of one of two bushings that rigidly interconnect spaced housing side plates of a rotary latch sub-assembly of the unit of FIGS. 1–14, with adjacent portions of a housing side plate also being shown.
Figure 17:
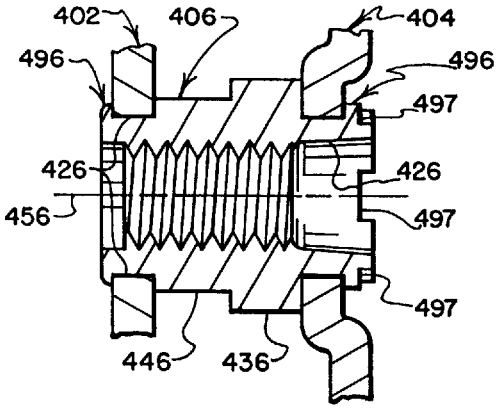
FIG. 17 is a sectional view showing headed end regions and adjacent housing side plate portions of the rotary latch sub-assembly, as seen from a plane indicated generally by a line 17—17 in FIG. 16.
Figure 18:
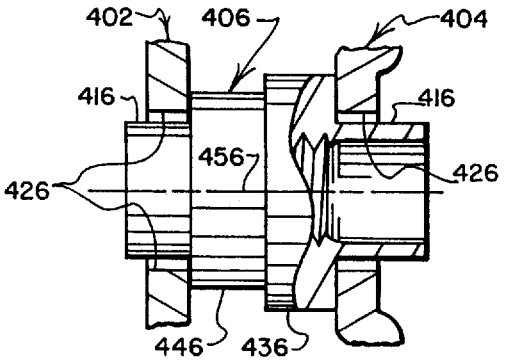
FIG. 18 is a sectional view similar to FIG. 17 but showing the bushing ends extending through hex holes formed by the housing side plate portions at a time before the ends of the bushing are expanded and have heads formed thereon.

The expansion of the end regions 416, 418 of the bushings 406, 408 and the formation of the heads 496, 498 thereon is carried out identically for each of the bushings 406, 408, with more detail with respect thereto being provided in FIGS. 16–18—wherein features of a typical one of the bushings 406 are illustrated.

Referring to FIG. 18, the bushing 406 is shown with its end regions 416 extending in a slip-fit through the hex holes 426 of the housing side plates 402, 404—which shows the situation before the end regions 416 are forcefully enlarged to bring them into seated engagement with the interior surfaces of the hex holes 426; and before the end regions 416 are "headed" to further aid in rigidly connecting them to the housing side plates 402, 404. Referring to FIG. 17, the end regions 416 of the bushing 406 are shown enlarged so as to engage and seat against the interior surfaces of the hex holes 426; with a rounded head 496 being formed adjacent the housing side plate 402, and with a head 496 that has been staked to provide depressions 497 therein being formed adjacent the housing side plate 404. Referring to FIG. 16, the head 496 that is staked adjacent the housing side plate 404 preferably has four of the indentations or depressions 497 formed therein, which are arranged in a circular array. The indentations 497, and the identical set of indentations 499 formed in one of the heads 498 of the bushing 408, help to ensure that tight, rotation-resistant, rigid and durable connections are formed between the bushings 406, 408 and the housing side plate 404—connections of sufficient strength and reliability that staking of the opposite ends of the bushings 406, 408 when rounded heads are formed to connect the bushings 406, 408 to the housing side plate 402.

Figure 19:
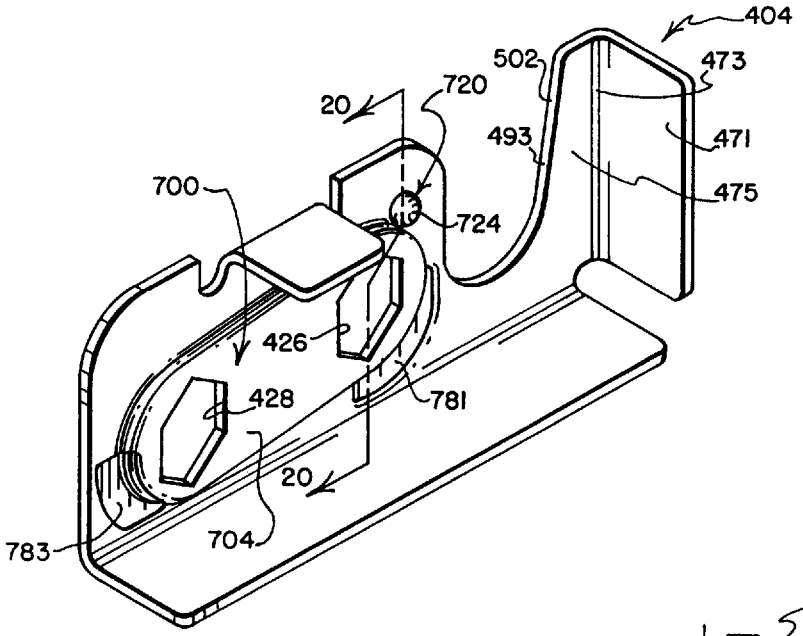
FIG. 19 is a perspective view on an enlarged scale showing principally interior portions of one of the housing side plates of the rotary latch sub-assembly.

Summarizing what has been found with respect to the connection of the bushings 406, 408 to the housing side plates 402, 404, mere expansion of the end regions 416, 418 into seated engagement with the hex holes 426, 428 may prove to be inadequate; and, combining such end region expansion with the formation of heads 496, 498 also may prove to be inadequate unless at least one of the heads 496, 498 on each of the bushings 406, 408 also is staked, typically as indicated by the numeral 497 in FIG. 16 (and as also is indicated by the numerals 497, 499 in FIGS. 1 and 2). And, in preferred practice, the heads 496, 498 that are selected for staking preferably are those that are adjacent the housing side plate 404 (which, as is depicted in FIG. 19 and as will be explained shortly, is the same housing side plate that has formed integrally therewith a transversely extending reinforcing flange 471 that is located in close proximity to a U-shaped notch 502 which defines a strike engagement surface 493).

Referring to FIG. 14, the bushings 406, 408 are generally cylindrical, and provide stepped central regions that have relatively large diameter portions 436, 438 and relatively medium diameter portions 446, 448, respectively. The end and central regions 416, 436, 446 of the bushing 406 are concentric about a first transversely extending axis that is designated by the numeral 456. The end and central regions 418, 438, 448 of the bushing 408 are concentric about a second transversely extending axis that is designated by the numeral 458. Optional internal threads (for example the threads indicated by the numerals 3466, 3468 in FIG. 18) may be formed within hollow interiors of the bushings 406, 408 to permit threaded fasteners of suitable size (not shown) to be connected to the subassembly 400 (should this be desirable).

Referring to FIGS. 13 and 14, the side plates 402, 404 define aligned first and second U-shaped notches 501, 502, respectively, that open rearwardly with respect to the closure 20 so that, as the closure 20 is moved toward its closed position, the resulting rearward movement of the side plates 402, 404 by the closure 20 will cause the central region 56 of the strike 50 to be received within the first and second U-shaped notches 501, 502 (see FIG. 3). Referring to FIGS. 4, 10, 13 and 14, a cooperating third U-shaped notch 503 is formed in the rotary jaw 410, and functions in concert with the first and second U-shaped notches 501, 502 to receive and latchingly retain the central region 56 of the strike 50 therein when the closure 20 is closed.

A feature of preferred practice resides in the utilization of the second U-shaped notch 502 (either alone or in concert with the first U-shaped notch 501) to define a strike engagement surface (or surfaces) that is (are) directly engageable by the central region 56 of the strike 50. If the first and second U-shaped notches 501, 502 are identically configured and positioned to extend in congruent alignment, a pair of congruently aligned strike engagement surfaces 492, 493 are defined by the notches 501, 502—which are engageable by the central region 56 of the strike 50 as the central region 56 moves into and is latchingly retained within the U-shaped notches 501, 502. If, on the other hand, the first U-shaped notch 501 is configured such that it is wider than the second U-shaped notch 502 (so that the surfaces that define the first notch 501 are positioned such that they cannot physically engage the strike 50), the only strike engagement surface that will be defined by either of the notches 501, 502 is the strike engagement surface 493 that Is defined by the second U-shaped notch 502.

By always ensuring that the strike engagement surface 493 is defined by the second U-shaped notch 502 (regardless of whether an additional strike engagement surface 492 is defined by the first U-shaped notch 501), advantage will always be taken of the close proximity presence to the second notch 502 (and to the strike engagement surface 493) of a transversely extending reinforcing flange 471 that is formed integrally with the second side plate 404 near one end thereof. A tight radius bend 473 connects the flange 471 to a narrow portion 475 (best seen in FIG. 19) of the second housing side plate 404 that extends along one side of the second notch 502 (and that defines the strike engagement surface 493). The close proximity presence of the transversely extending flange 471 and the bend 473 to the second notch 502 (and to the strike engaging surface 493 that is defined by the second notch 502) strengthens and rigidifies the second housing side plate 404 in the critical area adjacent the strike engaging surface 493.

In preferred practice, what is meant by the term "close proximity presence" in describing the close proximity of the transversely extending reinforcing flange 471 to the second notch 502 is exemplified by the arrangement that is depicted in the drawings where it will be seen that the distance by which the notch 502 is spaced from the flange 471 (which distance is approximately the width of the narrow portion 475—see FIG. 19) clearly is less than the distance by which the housing side plates 402, 404 are spaced apart.

While the second U-shaped notch 502 could be configured such that it is wider than the first U-shaped notch 501 (whereby the only strike engagement surface that would be defined by either of the notches 501, 502 is the strike engagement surface 492 that is defined by the first U-shaped notch 501), this option does not conform to the preferred practice of the present invention unless the first side plate 402 is provided with a transversely extending flange (not shown) that is substantially identical to the depicted flange 471, but which extends from the first side plate 402 toward the second side plate 404 to bridge the space therebetween (instead of extending from the second side plate 404 toward the first side plate 402 to bridge the space therebetween, as does the depicted flange 471).

Figure 20:
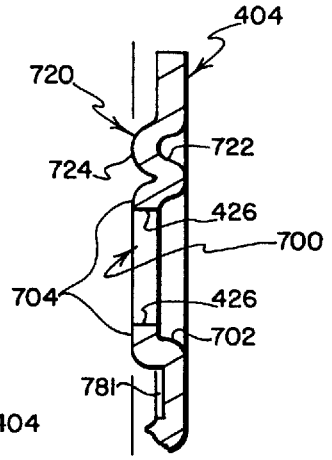
FIG. 20 is a sectional view as seen generally from a broken plane indicated by a line 20—20 in FIG. 19.
Figure 21:
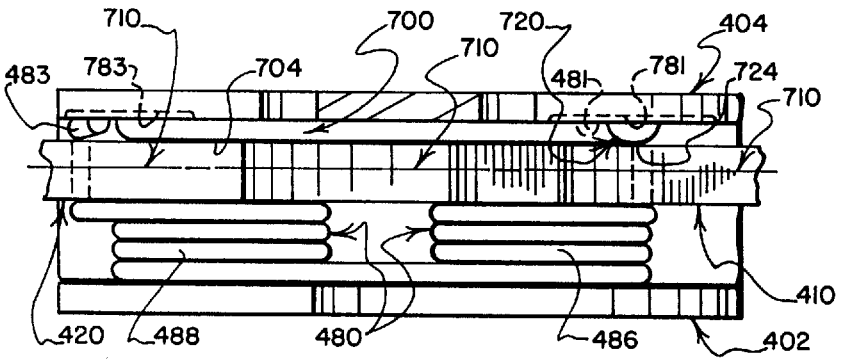
FIG. 21 is a bottom plan view, on an enlarged scale, showing selected portions of the rotary latch sub-assembly, with a tab portion of the housing side plate assembly of FIG. 19 broken away to permit underlying structure to be viewed; and, FIGS. 22–25 are perspective views showing four additional rotary latch and lock embodiments.
Figure 22:
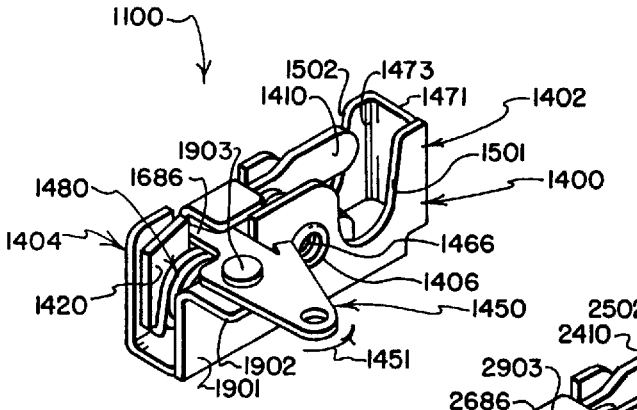
Figure 23:
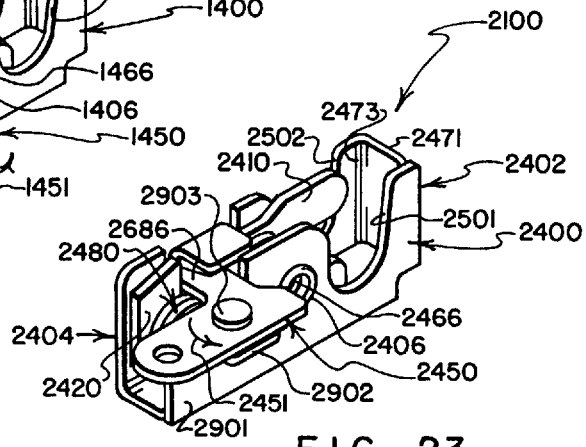
Figure 24:
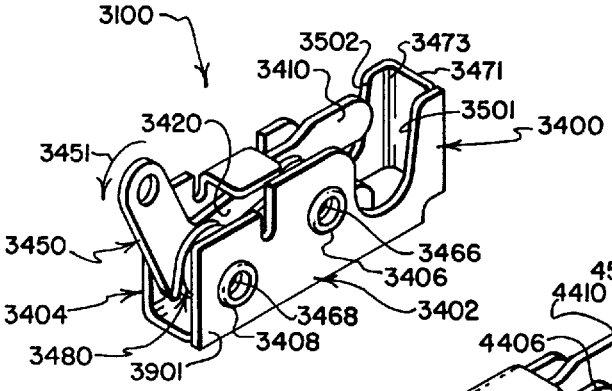
Figure 25:
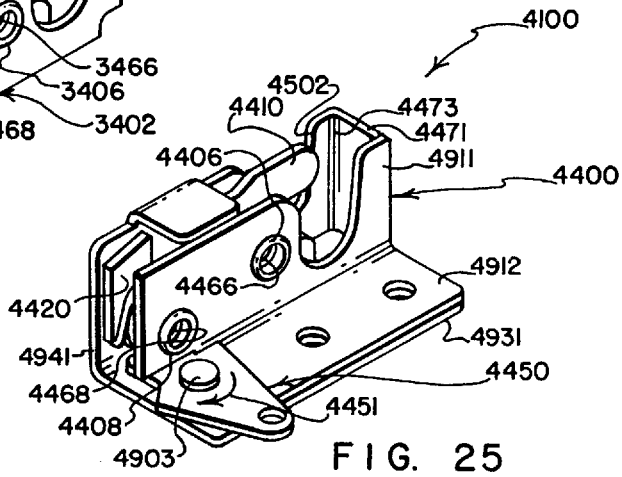

Referring to FIG. 19, the housing side plate 404 is provided with an inwardly projecting formation 700 —which causes the location of the hex holes 426, 428 to be set inwardly slightly (toward the location of the other housing side plate 402). Referring to FIG. 20, it will be seen that the inwardly projecting formation 700 is formed by causing a recess 702 to be stamped into the exterior side of the housing side plate 404 (it being noted that the recess 702 also is shown in others of the drawings, for example in FIGS. 1 and 2). Referring to FIGS. 20 and 21, it will be seen that the inwardly projecting formation 700 has a flat interior surface 704 —which, as is seen in FIG. 21, engages one side surface of each of the rotary jaw 410 and the rotary pawl 420 to position the rotary jaw 410 and the rotary pawl 420 substantially within a common central plane that is indicated in FIG. 21 by the numeral 710.

Referring to FIGS. 19–21, the housing side plate 404 also is provided with an inwardly projecting formation 720. Referring to FIG. 20, it will be seen that the inwardly projecting formation 720 is formed by causing a dimple 722 to be stamped into the exterior side of the housing side plate 404. Referring to FIGS. 20 and 21, the inwardly projecting formation 720 has an interior surface 724 which extends in the same plane as the flat interior surface 704 of the inwardly projecting formation 700—and which, as is best seen in FIG. 21, cooperates with the flat interior surface 704 to engage one side surface of the rotary jaw 410 to assist in maintaining the rotary jaw 410 within the common central plane 710 during angular movement of the jaw 410 and while the jaw 410 is at rest. By positioning the formation 720 near to the U-shaped notch 502, the formation 720 is particularly helpful in keeping portions of the jaw 410 from deflecting out of the common central plane 710 in the vicinity of the U-shaped notch 502 where the jaw 410 comes into engagement with the strike 50.

Referring to FIG. 19, arcuate-shaped recesses 781, 783 are formed in the interior side of the housing side plate 404. The recesses 781, 783 are shallow (see the depiction of a cross-section of the recess 781 that appears in FIG. 20) and are of equal depth—as is indicated by hidden lines in FIG. 21. It is the purpose of the recesses 781, 783 to receive and accommodate angular movement of a pair of spring ends 481, 483, respectively (see FIG. 14 wherein the torsion coil spring 480 that operates on the rotary jaw 410 and the rotary pawl 420 is depicted as defining the spring ends 481, 483 at opposite ends thereof). Inasmuch as the rotary jaw 410 and the rotary pawl 420 extend quite close to the interior face of the housing plate 404 (i.e., the rotary jaw 410 and the rotary pawl 420 are spaced from the interior face of the housing plate by the distance that the formation 700 projects inwardly to define the surface 704), there is relatively little space between the housing side plate 404 and either of the jaw 410 or the pawl 420 to receive the spring ends 481, 483—and, the presence of the recesses 781, 783 affords greater space for the spring ends 481, 483 so that the spring ends 481, 483 do not bind or wear unduly as the jaw and pawl 410, 420 move relative to the side plate 404 (and during arcuate movements executed by the spring ends 481, 483 when the rotary jaw 410 and the rotary pawl 420 pivot about the axes 456, 458 of the bushings 406, 408).

Referring to FIG. 14, housed between the side plates 402, 404 are the rotary jaw 410 and the rotary pawl 420. The rotary jaw 410 has a mounting hole 411 that receives the bushing diameter 448 therein in a slip fit to mount the rotary jaw 410 on the bushing 408 for limited angular movement about the transversely extending axis 458. The rotary pawl 420 has a mounting hole 421 that receives the bushing diameter 446 therein in a slip fit to mount the rotary pawl 420 on the bushing 406 for limited angular movement about the transversely extending axis 456.

Also housed between the side plates 402, 404 is the torsion coil spring 480. The spring 480 has a first coil 486 that extends about the diameter 436 of the bushing 406, and a second coil 488 that extends about the diameter 438 of the bushing 408. An end 481 of the spring 480 engages the rotary jaw 410 for biasing the rotary jaw 410 in a direction of angular movement about the axis 458 that is indicated by an arrow 485. An opposite end 483 of the spring 480 engages the rotary pawl 420 for biasing the rotary pawl 420 in a direction of angular movement about the axis 456 that is indicated by an arrow 487.

Referring to FIGS. 7, 10 and 14, the rotary jaw 410 and the rotary pawl 420 are provided with engageable formations 413, 423, respectively, that cooperate to "preliminarily latch" the rotary jaw 410 in engagement with the central region 56 of the strike 50 after the strike 50 has moved only a short distance into the aligned first and second U-shaped notches 501, 502 during movement of the closure 20 toward its closed position.

Referring to FIG. 10, if the lock unit 100 is preferred to not include a "preliminary latching" capability, the formation 413 can be eliminated from the rotary jaw 410 (as is indicated by a dotted line 412)—and this is the only alteration needed to effect this feature modification.

Referring to FIG. 4, the rotary jaw 410 and the rotary pawl 420 also are provided with engageable formations 415, 423, respectively, that cooperate to "fully latch" the rotary jaw 410 in engagement with the central region 56 of the strike 50 after the strike 50 has moved as far as it is going to move into the aligned first and second U-shaped notches 501, 502 as the closure 20 is moved to its fully closed position. When the engageable formations 415, 423 are engaged (as is depicted in FIG. 4), the rotary jaw 410 is prevented by the rotary pawl 420 from executing unlatching movement until the rotary pawl 420 is rotated about the axis 456 to a pawl-releasing position wherein the engageable formations 415, 423 disengage to permit the rotary jaw 410 to rotate away from its fully latched position toward its unlatched position wherein the strike 50 is free to move out of the third U-shaped notch 503 that is defined by the rotary jaw 410. This type of pawl-controlled jaw latching action is well known to those who are skilled in the art, and is further illustrated and described in the patents that are identified above.

To move the rotary pawl 420 in opposition to the action of the torsion coil spring 480 (i.e., in a direction opposite the arrow 487) from a pawl-retaining position (depicted in FIG. 4) to a pawl-releasing position (depicted in FIG. 7), the operating arm 450 is pivoted (about the mounting post 350 from the "primary" position depicted in FIG. 3 to the "secondary" position depicted in FIG. 6—which can only be done if the lock mechanism 500 has been operated to position the cam 520 in its unlocked position, as shown in FIG. 6) by operating the handle (to pivot the handle 240 about the axis of the pin 280 from its normal non-operated position shown in FIGS. 1 and 5 to its operated position shown in FIGS. 7 and 8). When the operated handle 240 is released, it returns to its non-operated position under the influence of the spring 290, hence the rearward extending projection 250 no longer remains in the "second" position of FIG. 8 where it holds the operating arm 450 in its "secondary" position (shown in FIG. 6). As the projection 250 returns to the "first" position of FIGS. 1 and 5, the operating arm 450 is caused to return to its "primary" position (shown in FIG. 3) due to the biasing action of the spring 380.

So long as the rotary jaw 410 of the unit 100 is in its unlatched position (depicted in FIGS. 1 and 7), the rotary jaw 410 always can be slammed into latching engagement with the strike 50. This is true regardless of how other relatively movable components of the unit 100 may be positioned. As the rotary jaw 410 receives the strike 50 within its third U-shaped notch 503, and as the strike 50 moves into the aligned first and second U-shaped notches 501, 502 of the housing side plates 402, 404, the strike 50 becomes cooperatively confined by the combined action of the first, second and third notches 501, 502, 503. When the strike 50 reaches the position that is depicted in FIG. 10, the rotary pawl 420 and the rotary jaw 410 become "preliminarily latched" (i.e., the engagement formations 413, 423 engage to prevent unlocking of the rotary jaw 410). When the strike 50 reaches the fully latched position depicted in FIG. 4, the engagement formations 415, 423 engage to fully lock the closure 20 in its closed position.

Referring to FIGS. 12 and 13, to securely connect the "handle and housing assembly" or "front module" 200 to the "bracket, latch and linkage assembly" or "rear module" 300 (so that the assemblies 200, 300 will be securely retained in place on the closure 20), threaded studs 969 are provided that project rearwardly from the back wall 212 of the pan-shaped housing 210 through openings 979 that are formed through the flat wall 312 of the mounting bracket 310, and lock nuts 989 are threaded onto the studs 969 and tightened in place so that the gasket set 120 or 1120 that extends about the mounting opening 34 or 1034 is compressed to form a weather tight seal as the front and rear assemblies are securely connected by the fasteners 969, 989. By this arrangement, the assemblies 200, 300 are quickly, easily and yet securely connected and fastened in place on the closure, with proper alignment and registry of the assemblies 200, 300 being ensured.

Referring to FIGS. 12 and 13, the key-operated cam lock assembly 500 is a commercially purchased assembly available from a wide variety of sources, and is selected to provide a quarter-turn for the cam 520, with the key 510 (see, for example, FIGS. 4 and 5) preferably being removable in both the "locked" position of the cam 520 (depicted in FIG. 3) and the "unlocked" position of the cam 520 (depicted in FIG. 6). Referring to FIG. 13, the assembly 500 has a housing 530 with threaded exterior portions 532, and with opposed flat surfaces 539 (only one of which is shown in FIG. 13) that engage the flats 239 of the lock mount opening 238 to prevent the housing 530 from rotating relative to the pan-shaped housing 210. A nut 540 is threaded onto the threaded exterior portions 532 of the body 530 to hold the lock assembly 500 in place on the pan-shaped housing 210.

So long as the key-locking assembly 500 positions the cam 520 in its "unlocked" position, as is depicted in FIGS. 6, 8, 9 and 11, pivotal movement of the operating arm will not be impeded by the cam 520—hence, the operating handle 240 can be pivoted out of its nested, non-operated position (shown in FIG. 5) to its extended, operated position (shown in FIG. 8) to cause the tab 250 to pivot the operating arm to pivot the rotary pawl 420 away from its normal jaw-retaining position (shown in FIG. 4) toward its jaw-releasing position (shown in FIG. 7) to release the pawl formation 423 from engaging either of the jaw formations 413, 415, whereupon the rotary jaw 420 pivots under the influence of the spring 480 away from its latched position (shown in FIG. 4) to its unlatched position (shown in FIG. 7) to release the strike 50.

Referring to FIG. 15, internal threads 466, 468 may optionally be provided within the hollow interiors of the bushings 406, 408. The provision of such threads is particularly useful when features of the rotary lock sub-assembly 400 described above are utilized in so-called "stand alone" rotary lock assemblies of the type that are indicated in FIGS. 22, 23, 24 and 25 by the numerals 1400, 2400, 3400 and 4400, respectively.

While the first side plate 402 of the rotary latch sub-assembly 400 is formed integrally with another element (i.e., it comprises a rearwardly turned flange of the mounting bracket 310), the stand-alone rotary latch units 1400, 2400, 3400, 4400 utilize independent first housing side plates 1402, 2402, 3402, 4402, respectively. In the embodiments 1400, 2400, 3400 of FIGS. 22–24, the side plates 1402, 2402, 3402 take the form of substantially flat stampings 1901, 2901, 3901, respectively; however, in the embodiment 4400 of FIG. 25, the side plate 4402 comprises one leg 4911 of a pair of perpendicular extending legs 4911, 4912 of an angle-iron-shaped stamping 4901.

The stampings 1901, 2901 that are employed in the alternative rotary latch embodiments 1400, 2400 (depicted in FIGS. 22 and 23, respectively) have integrally formed, transversely extending tabs 1902, 2902 that carry pivot pins 1903, 2903 for pivotally mounting associated operating arms 1450, 2450, respectively. The stamping 3901 that is employed in the alternative rotary latch embodiment 3400 (see FIG. 24) has no corresponding tab for mounting its associated operating arm 3450; rather, the operating arm 3450 is formed as an integral extension of the rotary pawl 3420. The stamping 4901 that is employed in the alternative rotary latch embodiment 4400 (see FIG. 25) utilizes the leg 4912 of the stamping 4901, and an adjacent leg 4931 of a similarly configured angle-iron-shaped stamping 4941 (that defines the second housing side plate 4404) to mount a pivot pin 4903 which pivotally mounts an associated operating arm 4450. While the operating arms 1450, 2450 are positioned to pivot in the directions of arrows 1451, 2451 to effect unlatching movements of their associated rotary pawls 1420, 2420, the operating arm 4450 is positioned to pivot in the direction of arrow 4451 to effect unlatching movement of its associated rotary pawl 4420. Pivotal movement of the operating arm 3450 in the direction of arrow 3451 effects unlatching movement of its associated rotary pawl 3420.

In function and operation, the stand-alone rotary latch embodiments 1400, 2400, 3400, 4400 are identical to the rotary latch sub-assembly 400 described above. The housing side plates 1402, 1404, 2402, 2404, 3402, 3404 and 4402, 4404 have features that are identical to the described features of the housing side plates 402, 404 and utilize bushings 1406, 1408, 2406, 2408, 3406, 3408 and 4406, 4408 that are identically coupled thereto in the manner that has been described in conjunction with the busings 406, 408 to mount rotary jaws and pawls 1410, 1420, 2410, 2420, 3410, 3420 and 4410, 4420 that are identical to the rotary jaw and pawl 410, 420.

Components of the latch embodiments 1400, 2400, 3400, 4400 that correspond to components of the latch embodiment 400 are indicated in FIGS. 22, 23, 24 and 25, respectively, by numerals that are the same as those used with the latch embodiment 400 but have the numbers "one thousand," "two thousand," "three thousand," and "four thousand" added thereto, respectively. The direct correspondence resulting from the use of identical components in the latch embodiments 400, 1400, 2400, 3400, 4400 (and the use in FIGS. 22–25 of "corresponding" numerals to designate such "corresponding" components) makes it unnecessary to repeat the above-provided component descriptions for each of the embodiments 1400, 2400, 3400, 4400, as will be readily understood by those who are skilled in the art.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A rotary latch for mounting on a closure for releasably retaining the closure in a closed position by latchingly engaging a suitably configured strike formation, comprising:

a) elongate housing means, including:

i) an elongate, generally rectangular first housing side plate having opposed end regions near opposite ends of the length thereof, with the first housing side plate defining a first U-shaped notch located near one of the opposed end regions of the first housing side plate, and defining a substantially flat first side wall portion that extends along the length of the first housing side plate from the other of the opposed end regions thereof to the first U-shaped notch;

ii) an elongate, generally rectangular second housing side plate having opposed end regions near opposite ends of the length thereof with one of the opposed end regions of the second housing side plate overlying said one end region of the first housing side plate, with the second housing side plate defining a second U-shaped notch located near said one end region of the second housing side plate, and defining a substantially flat second side wall portion that extends along the length of the second housing side plate from the other of the opposed end regions thereof to the second U-shaped notch to overlie the first side wall portion of the first housing side plate, with the second U-shaped notch being configured and positioned by the second housing side plate to substantially align with the first U-shaped notch;

iii) spacer means for extending transversely between and for rigidly connecting with the first and second elongate side wall portions for holding in substantially parallel-extending overlying relationship the first and second housing side plates, with the spacer means comprising only a first spacer and a second spacer, with the first spacer extending along a first transverse axis that intersects each of the first and second overlying side wall portions at a location that is relative near to said opposite site end regions of the first and second housing side plates, with the second spacer extending along a second transverse axis that intersects each of the first and second overlying side wall portions at a location that is substantially midway between the opposite ends of the first and second housing side plates, and, with the first and second transverse axes extending substantially parallel to each other in a direction that extends transversely between the overlying side wall portions of the first and second housing side plates;

b) rotary means comprising only two rotary latching elements each of which is carried by a separate one of the first and second spacers, namely a rotary jaw and a rotary pawl that extend substantially within a common plane located between the overlying side wall portions of the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation;

c) wherein the first and second U-shaped notches open generally in a direction that is substantially opposite to a direction of travel extending along a path of travel that is followed by the closure in moving away from a slightly open position toward the closed position, with each of the first and second notches being defined, at least in part, by a pair of spaced-apart side surfaces that extend along opposite sides of said path of travel and that are smoothly interconnected by an associated curved surface, and with at least one of the associated curved surfaces having a radius of curvature that substantially matches the radius of curvature of a generally cylindrical strike formation portion that is received within the first, second and third U-shaped notches when the strike formation is latchingly engaged by the rotary latch;

d) wherein a selected one of the first and second housing side plates has a strike engagement surface that is configured to be directly engaged by a strike formation that is received within the first, second and third U-shaped notches, which strike engagement surface is defined by at least a portion of a chosen one of the pair of spaced-apart side surfaces of the U-shaped notch of the selected one of the side plates, which chosen one of the side surfaces is the side surface that is located farthest from the second transverse axis about which the rotary jaw is rotatable;

e) housing side plate reinforcement means for strengthening and enhancing the rigidity of said selected one of the first and second housing side plates by providing in close proximity presence to the U-shaped notch of the selected one of the side plates a transversely extending flange:

i) that is formed integrally with said selected housing side plate at said one end thereof;

ii) that substantially parallels the first and second transversely extending axes so as to transversely bridge between the overlying said one end regions of the first and second housing side plates;

iii) that is connected by a relatively small radius right angle bend to such portions of said selected housing side plate as define the strike engagement surface; and, iv) with said flange and said bend being located in close proximity to the strike engagement surface so as to cooperate in rigidifying and strengthening said portions of said selected housing side plate that define the strike engagement surface; and, f) wherein at least a designated one of the first and second spacers has at least one designated enlarged end region that extends into and engages a separate, associated hex-shaped opening formed through a designated one of the first and second housing side plates to establish a secure, rotation resistant connection between the designated one of the spacers and the designated one of the housing side plates.

2. The latch of claim 1 wherein each of the first and second spacers has at least one designated enlarged end region that extends into and engages a separate, associated hex-shaped opening formed through a designated one of the first and second housing side plates to establish secure, rotation resistant connections between the first and second spacers and the designated one of the housing side plates.

3. The latch of claim 2 wherein both of the opposite ends of each of the first and second spacers are enlarged and extend through and engage hex-shaped openings defined by the first and second housing side plates.

4. The latch of claim 1 wherein the at least one designated enlarged end region that extends completely through the associated hex-shaped opening defines a head formation that overlies and engages portions of the designated housing side plate that are located adjacent the associated hex-shaped opening to aid in establishing a secure, rotation resistant connection between the designated one of the spacers and the designated one of the housing side plates.

5. The latch of claim 4 wherein at least one designated end region has a set of spaced depression marks formed in the head formation, which depression marks overlie portions of the perimeter of the associated hex-shaped opening.

6. The latch of claim 1 wherein:

a) the third U-shaped notch is defined by a portion of the rotary jaw that moves to sufficiently align the directions in which the first, second and third U-shaped notches open when the rotary jaw is in its unlatched position to permit movement of the strike formation into and out of the first, second and third U-shaped notches, and to cause the first, second and third U-shaped notches to progressively close about portions of a strike formation that are received therein as the rotary jaw is moved toward its latched position during closing movement of the closure on which the rotary latch is mounted; and, b) the rotary jaw and the rotary pawl are configured i) to permit the rotary pawl to effect a preliminary form of latching engagement with the rotary jaw that partially restricts the range of angular movement through which the rotary jaw can rotate in moving away from its fully latched position, and ii) to permit the rotary pawl to effect a fully latched form of latching engagement with the rotary jaw wherein the rotary jaw is retained in a fully latched position and is permitted to execute substantially no-angular movement while being retained in the fully latched position.

7. The latch of claim 1 wherein the operating arm is connected to a chosen one of the first and second housing side plates for engaging and moving the rotary pawl away from its jaw-retaining position toward its jaw-releasing position to "unlatch" the rotary jaw for movement from its latched position toward its unlatched position.

8. The latch of claim 1 wherein said transversely extending flange formed integrally with said selected housing side plate is located so closely to said strike engagement surface that the distance by which the transversely extending flange is spaced from said strike engagement surface is less than the distance that is maintained by the spacer means in holding the first and second elongate side wall portions in said parallel-extending overlying relationship.

9. The latch of claim 1 wherein said transversely extending flange is configured to bridge between the first and second housing side plates in a manner that substantially closes one end region of said elongate housing means.

10. The latch of claim 1 wherein a designated one of the first and second housing side plates defines a formation spaced from its associated U-shaped notch that projects toward the other of the first and second housing side plates for engaging a side surface of at least a designated one of the rotary latching elements to assist in guiding movements thereof about an associated one of the first and second transverse axes.

11. A rotary latch for mounting on a closure for releasably retaining the closure in a closed position by latchingly engaging a suitably configured strike formation, comprising:

a) elongate housing means, including:

i) an elongate, generally rectangular first housing side plate having opposed end regions near opposite ends of the length thereof, with the first housing side plate defining a first U-shaped notch located near one of the opposed end regions of the first housing side plate, and defining a substantially flat first side wall portion that extends along the length of the first housing side plate from the other of the opposed end regions thereof to the first U-shaped notch;

ii) an elongate, generally rectangular second housing side plate having opposed end regions near opposite ends of the length thereof with one of the opposed end regions of the second housing side plate overlying said one end region of the first housing side plate, with the second housing side plate defining a second U-shaped notch located near said one end region of the second housing side plate, and defining a substantially flat second side wall portion that extends along the length of the second housing side plate from the other of the opposed end regions thereof to the second U-shaped notch to overlie the first side wall portion of the first housing side plate, with the second U-shaped notch being configured and positioned by the second housing side plate to substantially align with the first U-shaped notch;

iii) spacer means for extending transversely between and for rigidly connecting with the first and second elongate side wall portions for holding in substantially parallel-extending overlying relationship the first and second housing side plates, with the spacer means comprising only a first spacer and a second spacer, with the first spacer extending along a first transverse axis that intersects each of the first and second overlying side wall portions at a location that is relative near to said opposite end regions of the first and second housing side plates, with the second spacer extending along a second transverse axis that intersects each of the first and second overlying side wall portions at a location that is substantially midway between the opposite ends of the first and second housing side plates, and, with the first and second transverse axes extending substantially parallel to each other in a direction that extends transversely between the overlying side wall portions of the first and second housing side plates;

b) rotary means comprising only two rotary latching elements each of which is carried by a separate one of the first and second spacers, namely a rotary jaw and a rotary pawl that extend substantially within a common plane located between the overlying side wall portions of the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation;

c) wherein the first and second U-shaped notches open generally in a direction that is substantially opposite to a direction of travel extending along a path of travel that is followed by the closure in moving away from a slightly open position toward the closed position, with each of the first and second notches being defined, at least in part, by a pair of spaced-apart side surfaces that extend along opposite sides of said path of travel and that are smoothly interconnected by an associated curved surface, and with at least one of the associated curved surfaces having a radius of curvature that substantially matches the radius of curvature of a generally cylindrical strike formation portion that is received within the first, second and third U-shaped notches when the strike formation is latchingly engaged by the rotary latch;

d) wherein the first housing side plate has a first strike engagement surface that is configured to be directly engaged by a strike formation that is received within the first, second and third U-shaped notches, with the first strike engagement surface being defined by at least a portion of a chosen one of the pair of spaced-apart side surfaces of the first U-shaped notch of the first housing side plate, which chosen one of the side surfaces is the side surface that is located farthest from the second transverse axis about which the rotary jaw is rotatable;

e) wherein the second housing side plate has a second strike engagement surface that is configured to be directly engaged by a strike formation that is received within the first, second and third U-shaped notches, with the second strike engagement surface being defined by at least a portion of a chosen one of the pair of spacedapart side surfaces of the second U-shaped notch of the second housing side plate, which chosen one of the side surfaces is the side surface that is located farthest from the second transverse axis about which the rotary jaw is rotatable;

f) housing side plate reinforcement means for strengthening and enhancing the rigidity of a selected one of the first and second housing side plates in the immediate vicinity of the associated one of the first and second strike engagement surfaces by providing in close proximity to said associated strike engagement surface a transversely extending flange:

i) that is formed integrally with said selected housing side plate;

ii) that substantially parallels the first and second transversely extending axes so as to transversely bridge between the overlying said one end regions of the first and second housing side plates;

iii) that is connected by a relatively small radius right angle bend to such portions of said selected housing side plate as define the strike engagement surface; and, iv) with said flange and said bend being located in close proximity to the strike engagement surface so as to cooperate in rigidifying and strengthening said portions of said selected housing side plate that define the strike engagement surface;

g) wherein at least a designated on e of the first and second spacers has at least one designated enlarged end region that extends into and engages with a separate, associated hex-shaped opening formed through a designated one of the first and second housing side plates to establish a secure, rotation resistant connection between the designated one of the spacers and the designated one of the housing side plates.

12. The latch of claim 11 wherein each of the first and second spacers has at least one designated enlarged end region that extends into and engages a separate, associated hex-shaped opening formed through a designated one of the first and second housing side plates to establish secure, rotation resistant connections between the first and second spacers and the designated one of the housing side plates.

13. The latch of claim 12 wherein both of the opposite ends of each of the first and second spacers are enlarged and extend through and engage hex-shaped openings defined by the first and second housing side plates.

14. The latch of claim 11 wherein the at least one designated enlarged end region that extends completely through the associated hex-shaped opening defines a head formation that overlies and engages portions of the designated housing side plate that are located adjacent the associated hex-shaped opening to aid in establishing a secure, rotation resistant connection between the designated one of the spacers and the designated one of the housing side plates.

15. The latch of claim 14 wherein the at least one designated end region has a set of spaced depression marks formed in the head formation, which depression marks overlie portions of the perimeter of the associated hex-shaped opening.

16. The latch of claim 11 wherein:

a) the third U-shaped notch is defined by a portion of the rotary jaw that moves to sufficiently align the directions in which the first, second and third U-shaped notches open when the rotary jaw is in its unlatched position to permit movement of the strike formation into and out of the first, second and third U-shaped notches, and to cause the first, second and third U-shaped notches to progressively close about portions of a strike formation that are received therein as the rotary jaw is moved toward its latched position during closing movement of the closure on which the rotary latch is mounted; and, b) the rotary jaw and the rotary pawl are configured i) to permit the rotary pawl to effect a preliminary form of latching engagement with the rotary jaw that partially restricts the range of angular movement through which the rotary jaw can rotate in moving away from its fully latched position, and ii) to permit the rotary pawl to effect a fully latched form of latching engagement with the rotary jaw wherein the rotary jaw is retained in a fully latched position and is permitted to execute substantially no angular movement while being retained in the fully latched position.

17. The latch of claim 11 wherein the operating arm is connected to a chosen one of the first and second housing side plates for engaging and moving the rotary pawl away from its jaw-retaining position toward its jaw-releasing position to "unlatch" the rotary jaw for movement from its latched position toward its unlatched position.

18. The latch of claim 11 wherein said transversely extending flange formed integrally with said selected housing side plate is located so closely to said associated strike engagement surface that the distance by which the transversely extending flange is spaced from said associated strike engagement surface is less than the distance that is maintained by the spacer means in holding the first and second elongate side wall portions in said parallel-extending overlying relationship.

19. The latch of claim 11 wherein said transversely extending flange is configured to bridge between the first and second housing side plates in a manner that substantially closes one end region of said elongate housing means.

20. The latch of claim 11 wherein a designated one of the first and second housing side plates defines a formation spaced from its associated U-shaped notch that projects toward the other of the first and second housing side plates for engaging a side surface of at least a designated one of the rotary latching elements to assist in guiding movements thereof about an associated one of the first and second transverse axes.

21. A rotary latch for mounting on a closure for releasably retaining the closure in a closed position by latchingly engaging a suitably configured strike formation, comprising:

a) elongate housing means, including:

i) an elongate, substantially flat, generally rectangular first housing side plate that has major portions thereof extending substantially in a common first plane, and that has opposed end regions near opposite ends of the length thereof, with the first housing side plate defining a first U-shaped notch located near one of the opposed end regions of the first housing side plate, and defining a substantially flat first side wall portion that extends along the length of the first housing side plate from the other of the opposed end regions thereof to the first U-shaped notch;

ii) an elongate, substantially flat, generally rectangular second housing side plate that has major portions thereof extending substantially in a common second plane that substantially parallels the common first plane, and that has opposed end regions near opposite ends of the length thereof with one of the opposed end regions of the second housing side plate overlying said one end region of the first housing side plate, with the second housing side plate defining a second U-shaped notch located near said one end region of the second housing side plate, and defining a substantially flat second side wall portion that extends along the length of the second housing side plate from the other of the opposed end regions thereof to the second U-shaped notch to overlie the first side wall portion of the first housing side plate, with the second U-shaped notch being configured and positioned by the second housing side plate to substantially align with the first U-shaped notch;

iii) spacer means for extending transversely between and for rigidly connecting with the first and second elongate side wall portions for holding in substantially parallel-extending overlying relationship the first and second housing side plates, with the spacer means comprising only a first spacer and a second spacer, with the first spacer extending along a first transverse axis that intersects each of the first and second overlying side wall portions at a location that is relative near to said opposite end regions of the first and second housing side plates, with the second spacer extending along a second transverse axis that intersects each of the first and second overlying side wall portions at a location that is substantially midway between the opposite ends of the first and second housing side plates, and, with the first and second transverse axes extending substantially parallel to each other in a direction that extends transversely between the overlying side wall portions of the first and second housing side plates;

b) rotary means comprising only two rotary latching elements each of which is carried by a separate one of the first and second spacers, namely a rotary jaw and a rotary pawl that extend substantially within a common central plane located between and substantially paralleling the common first plane and the common second plane, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation;

c) wherein the first and second U-shaped notches open generally in a direction that is substantially opposite to a direction of travel extending along a path of travel that is followed by the closure in moving away from a slightly open position toward the closed position, with each of the first and second notches being defined, at least in part, by a pair of spaced-apart side surfaces that extend along opposite sides of said path of travel and that are smoothly interconnected by an associated curved surface, and with at least one of the associated curved surfaces having a radius of curvature that substantially matches the radius of curvature of a generally cylindrical strike formation portion that is received within the first, second and third U-shaped notches when the strike formation is latchingly engaged by the rotary latch;

d) wherein a selected one of the first and second housing side plates has a strike engagement surface that is configured to be directly engaged by a strike formation that is received within the first, second and third U-shaped notches, which strike engagement surface is defined by at least a portion of a chosen one of the pair of spaced-apart side surfaces of the U-shaped notch of the selected one of the side plates, which chosen one of the side surfaces is the side surface that is located farthest from the second transverse axis about which the rotary jaw is rotatable;

e) housing side plate reinforcement means for strengthening and enhancing the rigidity of said selected one of the first and second housing side plates by providing in close proximity presence to the U-shaped notch of the selected one of the side plates a transversely extending flange:

i) that is formed integrally with said selected housing side plate at said one end thereof;

ii) that substantially parallels the first and second transversely extending axes so as to transversely bridge between the overlying said one end regions of the first and second housing side plates;

iii) that is connected by a relatively small radius right angle bend to such portions of said selected housing side plate as define the strike engagement surface; and, iv) with said flange and said bend being located in close proximity to the strike engagement surface so as to cooperate in rigidifying and strengthening said portions of said selected housing side plate that define the strike engagement surface; and, f) wherein a designated one of the first and second housing side plates defines formations means extending out of the associated one of the common first and second planes in a direction extending toward the common central plane for engaging and assisting in guiding at least a designated one of the rotary jaw and the rotary pawl during angular movement thereof within the common central plane.

22. The latch of claim 21 wherein the formation means includes a stamped dimple-shaped formation that extends into engagement with the rotary jaw for guiding angular movements of the rotary jaw within the common central plane.

23. The latch of claim 21 wherein the spring biasing of the rotary jaw and the rotary pawl is effected by torsion coil spring means for providing first and second coils of spring wire extending respectively about the first and second spacers, with the first and second coils respectively being connected to first and second spring end regions that each connect with a separate one of the rotary jaw and the rotary pawl for moving angularly therewith, and wherein the designated one of the first and second housing side plates defines at least one recess into which at least one of the first and second spring end regions extends.

24. The latch of claim 23 wherein each of the rotary raw and the rotary pawl is rotatable during normal latching and unlatching movements within a designated range of angular movement, and wherein said at least one recess includes separate recess formations that each receive a separate one of the first and spring end regions, and within which recess formations the spring end regions may move angularly in conjunction with corresponding angular movements of the rotary jaw and rotary pawl.

25. The latch of claim 21 wherein at least a designated one of the first and second spacers has at least one designated enlarged end region that extends into and engages a separate, associated hex-shaped opening formed through a designated one of the first and second housing side plates to establish a secure, rotation resistant connection between the designated one of the spacers and the designated one of the housing side plates.

26. The latch of claim 25 wherein each of the first and second spacers has at least one designated enlarged end region that extends into and engages a separate, associated hex-shaped opening formed through a designated one of the first and second housing side plates to establish secure, rotation resistant connections between the first and second spacers and the designated one of the housing side plates.

27. The latch of claim 26 wherein both of the opposite ends of each of the first and second spacers are enlarged and extend through and engage hex-shaped openings defined by the first and second housing side plates.

28. The latch of claim 25 wherein the at least one designated enlarged end region that extends completely through the associated hex-shaped opening defines a head formation that overlies and engages portions of the designated housing side plate that are located adjacent the associated hex-shaped opening to aid in establishing a secure, rotation resistant connection between the designated one of the spacers and the designated one of the housing side plates.

29. The latch of claim 25 wherein the at least one designated end region has a set of spaced depression marks formed in the head formation, which depression marks overlie portions of the perimeter of the associated hex-shaped opening.

30. The latch of claim 21 wherein:

a) the third U-shaped notch is defined by a portion of the rotary jaw that moves to sufficiently align the directions in which the first, second and third U-shaped notches open when the rotary jaw is in its unlatched position to permit movement of the strike formation into and out of the first, second and third U-shaped notches, and to cause the first, second and third U-shaped notches to progressively close about portions of a strike formation that are received therein as the rotary jaw is moved toward its latched position during closing movement of the closure on which the rotary latch is mounted; and, b) the rotary jaw and the rotary pawl are configured i) to permit the rotary pawl to effect a preliminary form of latching engagement with the rotary jaw that partially restricts the range of angular movement through which the rotary jaw can rotate in moving away from its fully latched position, and ii) to permit the rotary pawl to effect a fully latched form of latching engagement with the rotary jaw wherein the rotary jaw is retained in a fully latched position and is permitted to execute substantially no angular movement while being retained in the fully latched position.

31. The latch of claim 21 wherein the operating arm is connected to a chosen one of the first and second housing side plates for engaging and moving the rotary pawl away from its jaw-retaining position toward its jaw-releasing position to "unlatch" the rotary jaw for movement from its latched position toward its unlatched position.

32. The latch of claim 21 wherein said transversely extending flange formed integrally with said selected housing side plate is located so closely to said strike engagement surface that the distance by which the transversely extending flange is spaced from said strike engagement surface is less than the distance that is maintained by the spacer means in holding the first and second elongate side wall portions in said parallel-extending overlying relationship.

33. The latch of claim 21 wherein said transversely extending flange is configured to bridge between the first and second housing side plates in a manner that substantially closes one end region of said elongate housing means.

34. A rotary latch for mounting on a closure for releasably retaining the closure in a closed position by latchingly engaging a suitably configured strike formation, comprising:

a) elongate housing means, including:

i) an elongate, substantially flat, generally rectangular first housing side plate that has major portions thereof extending substantially in a common first plane, and that has opposed end regions near opposite ends of the length thereof, with the first housing side plate defining a first U-shaped notch located near one of the opposed end regions of the first housing side plate, and defining a substantially flat first side wall portion that extends along the length of the first housing side plate from the other of the opposed end regions thereof to the first U-shaped notch;

ii) an elongate, substantially flat, generally rectangular second housing side plate that has major portions thereof extending substantially in a common second plane that substantially parallels the common first plane, and that has opposed end regions near opposite ends of the length thereof with one of the opposed end regions of the second housing side plate overlying said one end region of the first housing side plate, with the second housing side plate defining a second U-shaped notch located near said one end region of the second housing side plate, and defining a substantially flat second side wall portion that extends along the length of the second housing side plate from the other of the opposed end regions thereof to the second U-shaped notch to overlie the first side wall portion of the first housing side plate, with the second U-shaped notch being configured and positioned by the second housing side plate to substantially align with the first U-shaped notch;

iii) spacer means for extending transversely between and for rigidly connecting with the first and second elongate side wall portions for holding in substantially parallel-extending overlying relationship the first and second housing side plates, with the spacer means comprising only a first spacer and a second spacer, with the first spacer extending along a first transverse axis that intersects each of the first and second overlying side wall portions at a location that is relative near to said opposite end regions of the first and second housing side plates, with the second spacer extending along a second transverse axis that intersects each of the first and second overlying side wall portions at a location that is substantially midway between the opposite ends of the first and second housing side plates, and, with the first and second transverse axes extending substantially parallel to each other in a direction that extends transversely between the overlying side wall portions of the first and second housing side plates;

b) rotary means comprising only two rotary latching elements each of which is carried by a separate one of the first and second spacers, namely a rotary jaw and a rotary pawl that extend substantially within a common central plane located between and substantially paralleling the common first plane and the common second plane, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation;

c) wherein the first and second U-shaped notches open generally in a direction that is substantially opposite to a direction of travel extending along a path of travel that is followed by the closure in moving away from a slightly open position toward the closed position, with each of the first and second notches being defined, at least in part, by a pair of spaced-apart side surfaces that extend along opposite sides of said path of travel and that are smoothly interconnected by an associated curved surface, and with at least one of the associated curved surfaces having a radius of curvature that substantially matches the radius of curvature of a generally cylindrical strike formation portion that is received within the first, second and third U-shaped notches when the strike formation is latchingly engaged by the rotary latch;

d) wherein the first housing side plate has a first strike engagement surface that is configured to be directly engaged by a strike formation that is received within the first, second and third U-shaped notches, with the first strike engagement surface being defined by at least a portion of a chosen one of the pair of spaced-apart side surfaces of the first U-shaped notch of the first housing side plate, which chosen one of the side surfaces is the side surface that is located farthest from the second transverse axis about which the rotary jaw is rotatable;

e) wherein the second housing side plate has a second strike engagement surface that is configured to be directly engaged by a strike formation that is received within the first, second and third U-shaped notches, with the second strike engagement surface being defined by at least a portion of a chosen one of the pair of spaced-apart side surfaces of the second U-shaped notch of the second housing side plate, which chosen one of the side surfaces is the side surface that is located farthest from the second transverse axis about which the rotary jaw is rotatable;

f) housing side plate reinforcement means for strengthening and enhancing the rigidity of a selected one of the first and second housing side plates in the immediate vicinity of the associated one of the first and second strike engagement surfaces by providing in close proximity to said associated strike engagement surface a transversely extending flange:

i) that is formed integrally with said selected housing side plate;

ii) that substantially parallels the first and second transversely extending axes so as to transversely bridge between the overlying said one end regions of the first and second housing side plates;

iii) that is connected by a relatively small radius right angle bend to such portions of said selected housing side plate as define the strike engagement surface; and, iv) with said flange and said bend being located in close proximity to the strike engagement surface so as to cooperate in rigidifying and strengthening said portions of said selected housing side plate that define the strike engagement surface; and, g) wherein a designated one of the first and second housing side plates defines formations means extending out of the associated one of the common first and second planes in a direction extending toward the common central plane for engaging and assisting in guiding at least a designated one of the rotary jaw and the rotary pawl during angular movement thereof within the common central plane.

35. The latch of claim 34 wherein the formation means includes a stamped dimple-shaped formation that extends into engagement with the rotary jaw for guiding angular movements of the rotary jaw within the common central plane.

36. The latch of claim 34 wherein the spring biasing of the rotary jaw and the rotary pawl is effected by torsion coil spring means for providing first and second coils of spring wire extending respectively about the first and second spacers, with the first and second coils respectively being connected to first and second spring end regions that each connect with a separate one of the rotary jaw and the rotary pawl for moving angularly therewith, and wherein the designated one of the first and second housing side plates defines at least one recess into which at least one of the first and second spring end regions extends.

37. The latch of claim 36 wherein each of the rotary raw and the rotary pawl is rotatable during normal latching and unlatching movements within a designated range of angular movement, and wherein said at least one recess includes separate recess formations that each receive a separate one of the first and spring end regions, and within which recess formations the spring end regions may move angularly in conjunction with corresponding angular movements of the rotary jaw and rotary pawl.

38. The latch of claim 34 wherein at least a designated one of the first and second spacers has at least one designated enlarged end region that extends into and engages a separate, associated hex-shaped opening formed through a designated one of the first and second housing side plates to establish a secure, rotation resistant connection between the designated one of the spacers and the designated one of the housing side plates.

39. The latch of claim 38 wherein each of the first and second spacers has at least one designated enlarged end region that extends into and engages a separate, associated hex-shaped opening formed through a designated one of the first and second housing side plates to establish secure, rotation resistant connections between the first and second spacers and the designated one of the housing side plates.

40. The latch of claim 39 wherein both of the opposite ends of each of the first and second spacers are enlarged and extend through and engage hex-shaped openings defined by the first and second housing side plates.

41. The latch of claim 38 wherein the at least one designated enlarged end region that extends completely through the associated hex-shaped opening defines a head formation that overlies and engages portions of the designated housing side plate that are located adjacent the associated hex-shaped opening to aid in establishing a secure, rotation resistant connection between the designated one of the spacers and the designated one of the housing side plates.

42. The latch of claim 38 wherein the at least one designated end region has a set of spaced depression marks formed in the head formation, which depression marks over-lie portions of the perimeter of the associated hex-shaped opening.

43. The latch of claim 34 wherein:

a) the third U-shaped notch is defined by a portion of the rotary jaw that moves to sufficiently align the directions in which the first, second and third U-shaped notches open when the rotary jaw is in its unlatched position to permit movement of the strike formation into and out of the first, second and third U-shaped notches, and to cause the first, second and third U-shaped notches to progressively close about portions of a strike formation that are received therein as the rotary jaw is moved toward its latched position during closing movement of the closure on which the rotary latch is mounted; and, b) the rotary jaw and the rotary pawl are configured i) to permit the rotary pawl to effect a preliminary form of latching engagement with the rotary jaw that partially restricts the range of angular movement through which the rotary jaw can rotate in moving away from its fully latched position, and ii) to permit the rotary pawl to effect a fully latched form of latching engagement with the rotary jaw wherein the rotary jaw is retained in a fully latched position and is permitted to execute substantially no angular movement while being retained in the fully latched position.

44. The latch of claim 34 wherein the operating arm is connected to a chosen one of the first and second housing side plates for engaging and moving the rotary pawl away from its jaw-retaining position toward its jaw-releasing position to "unlatch" the rotary jaw for movement from its latched position toward its unlatched position.

45. The latch of claim 34 wherein said transversely extending flange formed integrally with said selected housing side plate is located so closely to said strike engagement surface that the distance by which the transversely extending flange is spaced from said strike engagement surface is less than the distance that is maintained by the spacer means in holding the first and second elongate side wall portions in said parallel-extending overlying relationship.

46. The latch of claim 34 wherein said transversely extending flange is configured to bridge between the first and second housing side plates in a manner that substantially closes one end region of said elongate housing means.

* * * * *